US005826633A

United States Patent [19]

Parks et al.

[11] Patent Number: 5,826,633

[45] Date of Patent: Oct. 27, 1998

[54] POWDER FILLING SYSTEMS, APPARATUS AND METHODS

[75] Inventors: Derrick J. Parks, San Carlos; Michael J. Rocchio, Hayward; Kyle Naydo, Sunnyvale; Dennis E. Wightman, Cupertino; Adrian E. Smith, Belmont, all of Calif.

[73] Assignee: Inhale Therapeutic Systems, Palo Alto, Calif.

[21] Appl. No.: 638,515

[22] Filed: Apr. 26, 1996

[51] Int. Cl.[6] ..... B65B 1/04

[52] U.S. Cl. ..... 141/18; 141/125; 141/129; 141/234; 141/237; 141/238; 141/241; 141/242; 141/280; 141/286

[58] Field of Search ..... 141/18, 67–71, 141/115, 125, 129, 234, 237, 238, 241, 242, 280, 286; 222/345, 346, 368, 636, 189.06; 209/311, 312, 315, 318, 380, 344, 352, 369; 128/203.15; 604/158

[56] References Cited

U.S. PATENT DOCUMENTS

| | | | |
|---|---|---|---|
| 2,049,870 | 8/1936 | Schiff | 209/244 |
| 2,531,245 | 11/1950 | Bailey | 141/125 |
| 2,540,059 | 1/1951 | Stirn et al. | 222/636 |
| 3,578,041 | 5/1971 | Obara | 141/59 |
| 3,804,245 | 4/1974 | Pendleton | 209/318 |
| 3,871,626 | 3/1975 | Wohlfarth | 259/36 |
| 3,874,431 | 4/1975 | Aronson | 141/1 |
| 3,899,417 | 8/1975 | Morris | 209/318 |
| 4,067,225 | 1/1978 | Dorman et al. . | |
| 4,320,657 | 3/1982 | Johnson, III | 73/432 |
| 4,509,568 | 4/1985 | Kawaguchi et al. | 141/129 |
| 4,616,152 | 10/1986 | Saito et al. | 310/334 |
| 4,640,322 | 2/1987 | Ballester . | |
| 4,684,041 | 8/1987 | Jones et al. | 222/161 |
| 4,688,610 | 8/1987 | Campbell | 141/83 |
| 4,719,409 | 1/1988 | Dorman . | |
| 4,953,643 | 9/1990 | Ellion et al. | 177/123 |
| 4,984,128 | 1/1991 | Cebon et al. . | |
| 5,143,126 | 9/1992 | Boesch et al. | 141/1 |
| 5,287,897 | 2/1994 | Gamberini | 141/130 |
| 5,366,122 | 11/1994 | Guentert et al. . | |
| 5,456,298 | 10/1995 | Tennis | 141/242 |
| 5,544,683 | 8/1996 | Guhl | 141/65 |
| 5,575,280 | 11/1996 | Gupte et al. | 128/203.15 |

FOREIGN PATENT DOCUMENTS

| | | |
|---|---|---|
| 949786 | 6/1974 | Canada . |
| 531329 | 8/1931 | Germany . |
| 234397 | 4/1986 | Germany . |
| 3607187 | 9/1987 | Germany . |
| 7-109031 | 4/1995 | Japan . |
| 913203 | 3/1982 | U.S.S.R. . |
| 1061030 | 12/1983 | U.S.S.R. . |
| 1309424 | 3/1973 | United Kingdom . |
| 1420364 | 1/1976 | United Kingdom . |
| 1475593 | 6/1977 | United Kingdom . |
| 9515340.9 | 7/1995 | United Kingdom . |
| WO 95/09615 | 4/1995 | WIPO . |
| WO 95/09616 | 4/1995 | WIPO . |
| WO 95/21768 | 8/1995 | WIPO . |
| WO 96/04082 | 2/1996 | WIPO . |
| WO 96/08284 | 3/1996 | WIPO . |
| WO 97/05018 | 2/1997 | WIPO . |

OTHER PUBLICATIONS

Perry Industries publication, "E–1300 Powder Filler", 2 pages.

*Primary Examiner*—David J. Walczak
*Assistant Examiner*—Timothy L. Maust
*Attorney, Agent, or Firm*—Townsend and Townsend and Crew

[57] ABSTRACT

Methods, systems and apparatus for the metered transport of fine powders into receptacles are provided. According to one exemplary method, the fine powder is first fluidized. At least a portion of the fluidized fine powder is then captured. The captured fine powder is then transferred to a receptacle, with the are provided transferred powder being sufficiently uncompacted so that it may be dispersed upon removal from the receptacle.

68 Claims, 20 Drawing Sheets

POWDER FILLING SYSTEMS, APPARATUS AND METHODS

BACKGROUND OF THE INVENTION

1. Field of the Invention

The present invention relates generally to the field of fine powder processing, and particularly to the metered transport of fine powders. More particularly, the present invention relates to systems, apparatus and methods for filling receptacles with unit dosages of non-flowable but dispersible fine powdered medicaments, particularly for subsequent inhalation by a patient.

Effective delivery to a patient is a critical aspect of any successful drug therapy. Various routes of delivery exist, and each has its own advantages and disadvantages. Oral drug delivery of tablets, capsules, elixirs, and the like, is perhaps the most convenient method, but many drugs are have disagreeable flavors, and the size of the tablets makes them difficult to swallow. Moreover, such medicaments are often degraded in the digestive tract before they can be absorbed. Such degradation is a particular problem with modern protein drugs which are rapidly degraded by proteolytic enzymes in the digestive tract. Subcutaneous injection is frequently an effective route for systemic drug delivery, including the delivery of proteins, but enjoys a low patient acceptance and produces sharp waste items, e.g. needles, which are difficult to dispose. Since the need to inject drugs on a frequent schedule such as insulin one or more times a day, can be a source of poor patient compliance, a variety of alternative routes of administration have been developed, including transdermal, intranasal, intrarectal, intravaginal, and pulmonary delivery.

Of particular interest to the present invention are pulmonary drug delivery procedures which rely on inhalation of a drug dispersion or aerosol by the patient so that the active drug within the dispersion can reach the distal (alveolar) regions of the lung. It has been found that certain drugs are readily absorbed through the alveolar region directly into blood circulation. Pulmonary delivery is particularly promising for the delivery of proteins and polypeptides which are difficult to deliver by other routes of administration. Such pulmonary delivery can be effective both for systemic delivery and for localized delivery to treat diseases of the lungs.

Pulmonary drug delivery (including both systemic and local) can itself be achieved by different approaches, including liquid nebulizers, metered dose inhalers (MDI's) and dry powder dispersion devices. Dry powder dispersion devices are particularly promising for delivering protein and polypeptide drugs which may be readily formulated as dry powders. Many otherwise labile proteins and polypeptides may be stably stored as lyophilized or spray-dried powders by themselves or in combination with suitable powder carriers. A further advantage is that dry powders have a much higher concentration that medicaments in liquid form.

The ability to deliver proteins and polypeptides as dry powders, however, is problematic in certain respects. The dosage of many protein and polypeptide drugs is often critical so it is necessary that any dry powder delivery system be able to accurately, precisely and repeatably deliver the intended amount of drug. Moreover, many proteins and polypeptides are quite expensive, typically being many times more costly than conventional drugs on a per-dose basis. Thus, the ability to efficiently deliver the dry powders to the target region of the lung with a minimal loss of drug is critical.

For some applications, fine powder medicaments are supplied to dry powder dispersion devices in small unit dose receptacles, often having a puncturable lid or other access surface (commonly referred to as blister packs). For example, the dispersion device described in copending U.S. patent application Ser. No. 08/309,691, filed Sep. 21, 1994 (Attorney Docket No. 15225-5), the disclosure of which is herein incorporated by reference, is constructed to receive such a receptacle. Upon placement of the receptacle in the device, a TRANSJECTOR™ multi-flow ejector assembly having a feed tube is penetrated through the lid of the receptacle to provide access to the powdered medicament therein. The TRANSJECTOR™ multi-flow ejector assembly also creates vent holes in the lid to allow the flow of air through the receptacle to entrain and evacuate the medicament. Driving this process is a high velocity air stream which is flowed past a portion of the tube, such as an outlet end, entraining air and thereby drawing powder from the receptacle, through the tube, and into the flowing air stream to form an aerosol for inhalation by the patient. The high velocity air stream transports the powder from the receptacle in a partially de-agglomerated form, and the final complete de-agglomeration takes place in the mixing volume just downstream of the high velocity air inlets.

Of particular interest to the present invention are the physical characteristics of poorly flowing powders. Poorly flowing powders are those powders having physical characteristics, such as flowability, which are dominated by cohesive forces between the individual units or particles (hereinafter "individual particles") which constitute the powder. In such cases, the powder does not flow well because the individual particles cannot easily move independently with respect to each other, but instead move as clumps of many particles. When such powders are subjected to low forces, the powder will tend not to flow at all. However, as the forces acting upon the powder is increased to exceed the forces of cohesion, the powder will move in large agglomerated "chunks" of the individual particles. When the powder comes to rest, the large agglomerations remain, resulting in a non-uniform powder density due to voids and low density areas between the large agglomerations and areas of local compression.

This type of behavior tends to increase as the size of the individual particles becomes smaller. This is most likely because, as the particles become smaller, the cohesive forces, such as Van Der Waals, electrostatic, friction, and other forces, become large with respect to the gravitational and inertial forces which may be applied to the individual particles due to their small mass. This is relevant to the present invention since gravity and inertial forces produced by acceleration, as well as other effected motivators, are commonly used to process, move and meter powders.

For example, when metering the fine powders prior to placement in the unit dose receptacle, the powder often agglomerates inconsistently, creating voids and excessive density variation, thereby reducing the accuracy of the volumetric metering processes which are commonly used to meter in high throughput production. Such inconsistent agglomeration is further undesirable in that the powder agglomerates need to be broken down to the individual particles, i.e. made to be dispersible, for pulmonary delivery. Such de-agglomeration often occurs in dispersion devices by shear forces created by the air stream used to extract the medicament from the unit dose receptacle or other containment, or by other mechanical energy transfer mechanisms (e.g., ultrasonic, fan/impeller, and the like). However, if the small powder agglomerates are too compacted, the shear forces provided by the air stream or other dispersing mechanisms will be insufficient to effectively disperse the medicament to the individual particles.

Some attempts to prevent agglomeration of the individual particles are to create blends of multi-phase powders (typically a carrier or diluent) where larger particles (sometimes of multiple size ranges), e.g. approximately 50 μm, are combined with smaller drug particles, e.g. 1 μm to 5 μm. In this case, the smaller particles attach to the larger particles so that under processing and filling the powder will have the characteristics of a 50 μm powder. Such a powder is able to more easily flow and meter. One disadvantage of such a powder, however, is that removal of the smaller particles from the larger particles is difficult, and the resulting powder formulation is made up largely of the bulky flowing agent component which can end up in the device, or the patient's throat.

Current methods for filling unit dose receptacles with powdered medicaments include a direct pouring method where a granular powder is directly poured via gravity (sometimes in combination with stirring or "bulk" agitation) into a metering chamber. When the chamber is filled to the desired level, the medicament is then expelled from the chamber and into the receptacle. In such a direct pouring process, variations in density can occur in the metering chamber, thereby reducing the effectiveness of the metering chamber in accurately measuring a unit dose amount of the medicament. Moreover, the powder is in a granular state which can be undesirable for many applications.

Some attempts have been made to minimize density variations by compacting the powder within, or prior to depositing it in the metering chamber. However, such compaction is undesirable, especially for powders made up of only fine particles, in that it decreases the dispersibility of the powder, i.e. reduces the chance for the compacted powder to be broken down to the individual particles during pulmonary delivery with a dispersion device.

It would therefore be desirable to provide systems and methods for the processing of fine powders which would overcome or greatly reduce these and other problems. Such systems and methods should allow for accurate and precise metering of the fine powder when divided into unit doses for placement in unit dose receptacles, particularly for low mass fills. The systems and methods should further ensure that the fine powder remains sufficiently dispersible during processing so that the fine powder may be used with existing inhalation devices which require the powder to be broken down to the individual particles before pulmonary delivery. Further, the systems and methods should provide for the rapid processing of the fine powders so that large numbers of unit dose receptacles can rapidly be filled with unit dosages of fine powder medicaments in order to reduce cost.

2. Description of the Background Art

U.S. Pat. No. 4,640,322 describes a machine which applies sub-atmospheric pressure through a filter to pull material directly from a hopper and laterally into a non-rotatable chamber.

U.S. Pat. No. 2,540,059 describes a powder filling apparatus having a wire loop stirrer for stirring powder in a hopper before directly pouring the powder into a metering chamber by gravity.

German patent DE 3607187 describes a mechanism for the metered transport of fine particles.

Product brochure, "E-1300 Powder Filler" describes a powder filler available from Perry Industries, Corona, Cailf.

U.S. Pat. No. 3,874,431 describes a machine for filling capsules with powder. The machine employs coring tubes that are held on a rotatable turret.

British Patent No. 1,420,364 describes a membrane assembly for use in a metering cavity employed to measure quantities of dry powders.

British Patent No. 1,309,424 describes a powder filling apparatus having a measuring chamber with a piston head used to create a negative pressure in the chamber.

Canadian Patent No. 949,786 describes a powder filling machine having measuring chambers that are dipped into the powder. A vacuum is then employed to fill the chamber with powder.

SUMMARY OF THE INVENTION

The invention provides systems, apparatus and methods for the metered transport of fine powders into unit dose receptacles. In one exemplary method, such fine powders are transported by first fluidizing the fine powders to form small agglomerates and/or to separate the powder into its constituents or individual particles, and then capturing at least a portion of the fluidized fine powder. The captured fine powder is then transferred to a receptacle, with the transferred powder being sufficiently uncompacted so that it can be substantially dispersed upon removal from the receptacle. Usually, the fine powder will comprise a medicament with the individual particles having a mean size that is less than about 100 μm, usually less than about 10 μm, and more usually in the range from about 1 μm to 5 μm.

In one preferable aspect, the fluidizing step comprises sifting the fine powder. Such sifting is usually best accomplished by cyclically translating a sieve to sift the fine powder through the sieve. The sieve preferably has apertures having a mean size in the range from about 0.05 mm to 6 mm, and more preferably from about 0.1 mm to 3 mm, and the sieve is translated at a frequency in the range from about 1 Hz to about 500 Hz, and more preferably from about 10 Hz to 200 Hz. In another aspect, the fine powder can optionally be sifted through a second sieve prior to sifting the fine powder through the first sieve. The second sieve is cyclically translated to sift the fine powder through the second sieve where it falls onto the first sieve. The second sieve preferably has apertures having a mean size in the range from about 0.2 mm to 10 mm, more preferably from 1 mm to 5 mm. The second sieve is translated at a frequency in the range from 1 Hz to 500 Hz, more preferably from 10 Hz to 200 Hz. In a further aspect, the first and the second sieves are translated in different, usually opposite, directions relative to each other. In an alternative aspect, the fine powder is fluidized by blowing a gas into the fine powder.

The fluidized powder (composed of small agglomerates and individual particles) is preferably captured by drawing air through a metering chamber (e.g., by creating a vacuum within a line that is connected to the chamber) that is positioned near the fluidized powder. The metering chamber is preferably placed below the sieves so that gravity can assist in sifting the powder. Filling the chamber with the sifted powder is controlled by the flow rate of the air flow through the chamber. The fluid drag force created by the constant flow of air on the relatively uniformly sized agglomerates or individual particles allows for a general uniform filling of the metering chamber. The flow rate may be adjusted to control the packing density of the powder within the chamber, and thereby control the resulting dosage size.

Optionally, a funnel can be placed between the first sieve and the metering chamber to funnel the fluidized fine powder into the metering chamber. Once metering has occurred, the fine powder is expelled from the metering chamber and into the receptacle. In an exemplary aspect, a compressed gas is introduced into the chamber to expel the captured powder from the chamber where they are received in the receptacle.

As the fine powder is captured in the metering chamber, the metering chamber is filled to overflowing. To adjust the amount of captured powder to the volume of the chamber, i.e. to be a unit dosage amount, the excess powder which has accumulated above the top of the chamber is removed. Optionally, an additional adjustment to the amount of the captured powder can be made by removing some of the powder from the chamber to reduce the size of the unit dosage. If desired, the powder which has been removed from the chamber when adjusting the dosage may be recirculated so that it can later be re-sifted into the metering chamber.

In a further aspect of the method, after adjusting the amount of captured powder, a step is provided for detecting or sensing the amount of powder remaining within the chamber. The captured powder is then expelled from the chamber. Optionally, a step may be provided for detecting or sensing whether substantially all of the captured powder was successfully expelled from the chamber to ensure that the correct amount, e.g. a unit dosage, has actually been placed in the receptacle. If substantially all of the captured powder is not expelled from the chamber, an error message may be produced. In still a further aspect, mechanical energy, such as sonic or ultrasonic energy, may be applied to the receptacle following the transferring step to assist in ensuring that the powder in the receptacle is sufficiently uncompacted so that they can be dispersed upon removal from the receptacle.

The invention provides an exemplary apparatus for transporting fine powder having a mean size in the range from about 1 $\mu$m to 20 $\mu$m to at least one receptacle. The apparatus includes a means for fluidizing the fine powder and a means for capturing at least a portion of the fluidized powder. A means is further provided for ejecting the captured powder from the capturing means and into the receptacle. The means for capturing preferably comprises a chamber, container, enclosure, or the like, and a means for drawing air at an adjustable flow rate through the chamber to assist in capturing the fluidized powder in the chamber.

The means for fluidizing the fine powder is provided so that the fine powder may be captured in the metering chamber without the creation of substantial voids and without excessive compaction of the fine powder. In this way, the chamber can reproducibly meter the amount of captured powder while also ensuring that the fine powder is sufficiently uncompacted so that it can be effectively dispersed when needed for pulmonary delivery.

In an exemplary aspect, the means for fluidizing comprises a sieve having apertures with a mean size in the range from about 0.05 mm to 6 mm, and more preferably from about 0.1 mm to 3 mm. A motor is provided for cyclically translating the sieve. The motor preferably translates the sieve at a frequency in the range from about 1 Hz to about 500 Hz, and more preferably from about 10 Hz to 200 Hz. Alternatively, the first sieve may be mechanically agitated or vibrated in an up and down motion to fluidize the powder. Optionally, the means for fluidizing may further include a second sieve having apertures with a mean size in the range from about 0.2 mm to 10 mm, more preferably from 1 mm to 5 mm. A second motor is provided for cyclically translating the second sieve, preferably at a frequency in the range from about 1 Hz to 500 Hz, more preferably from 10 Hz to 200 Hz. Alternatively, the second sieve may be ultrasonically vibrated in a manner similar to the first sieve. The first and second sieves are preferably translatably held within a sifter, with the second sieve being positioned above the first sieve. In one aspect, the sieves may be spaced apart by a distance in the range from about 0.001 mm to about 5 mm. The sifter preferably has a tapered geometry that narrows in the direction of the first sieve. With such a configuration, the fine powder may be placed on the second sieve which sifts the fine powder onto the first sieve. In turn, the fine powder on the first sieve is sifted out of the bottom of the sifter in a fluidized state where it is entrained by air flow and is captured in the metering chamber. In an alternative embodiment, the means for fluidizing comprises a source of compressed gas for blowing gas into the fine powder.

In one particularly preferable aspect, the chamber includes a bottom, a plurality of side walls, and an open top, with at least some of the walls being tapered inward from the top to the bottom. Such a configuration assists in the process of uniformly filling the chamber with the fluidized fine powder as well as allowing for the captured powder to be more easily expelled from the chamber. Provided at the bottom of the chamber is a port, with the port being in communication with a vacuum source. A filter having apertures with a mean size in the range from about 0.1 $\mu$m to 100 $\mu$m, more preferably from about 0.2 $\mu$m and 5 $\mu$m, and more preferably at about 0.8 $\mu$m, is preferably disposed across the port. In this manner, air is drawn through the chamber to assist in capturing the fluidized fine powder. In an alternative aspect, the vacuum source is variable so that the flow velocity of air through the chamber may be varied, preferably by varying the vacuum pressure on a downstream side of the filter. By varying the flow velocity in this manner, the density, and hence the amount, of powder captured in the container may be controlled. A compressed gas source is also in communication with the port to assist in ejecting the captured powder from the chamber.

The chamber preferably defines a unit dose volume, and a means is provided for adjusting the amount of captured powder in the chamber to the chamber volume so that a unit dose amount will be held by the chamber. Such an adjustment is needed since the chamber is filled to overflowing with the fine powder. The adjusting means preferably comprises an edge for removing the fine powder extending above the walls of the chamber. In still a further aspect, a means is provided for removing an additional amount of the captured powder from the chamber to adjust the unit dosage amount in the chamber. The means for removing the captured powder preferably comprises a scoop that is used to adjust the amount of captured powder to be a lesser unit dosage amount. Alternatively, the amount of captured powder may be adjusted by adjusting the size of the chamber. For example, the means for adjusting the amount of captured powder may comprise a second chamber which is interchangeable with the first chamber, with the second chamber having a volume that is different from the volume of the first chamber.

In another aspect, a means is provided for recycling the removed powder into the fluidizing means. In yet a further aspect, a means is provided for detecting whether substantially all of the captured powder is ejected from the chamber by the ejecting means. In still a further aspect, a funnel may optionally be provided for funneling the fluidized powder into the chamber.

The invention provides an exemplary system for simultaneous filling a plurality receptacles with unit dosages of a medicament of fine powder. The system includes an elongate rotatable member having a plurality of chambers about its periphery. A means is provided for fluidizing the fine powder, and a means is provided for drawing air through the chambers to assist in capturing the fluidized powder in the chambers. The system further includes a means for ejecting the captured powder from the chambers and into the receptacles. A controller is provided for controlling the means for drawing air and the ejecting means, and a means is provided for aligning the chambers with the fluidizing means and the receptacles.

Such a system is advantageous in rapidly filling a large number of receptacles with unit dosages of the medicament. The system is constructed such that the fine powder is fluidized and then captured in the chambers while the chambers are aligned with the fluidizing means. The rotatable member is then rotated to align selected ones of the chambers with selected ones of the receptacles, whereupon the captured powder in the selected chambers is ejected into the selected receptacles.

The rotatable member is preferably cylindrical in geometry. In one preferable aspect, an edge is provided adjacent the cylindrical member for removing excess powder from the chambers as the member is rotated to align the chambers with the receptacles.

In one particular aspect, the fluidizing means comprises a sieve having apertures with the mean size in the range from 0.05 mm to 6 mm, and more preferably from about 0.1 mm to 3 mm. A motor is provided for cyclically translating the sieve. In another aspect, the means for fluidizing further comprises a second sieve having apertures with a mean size in the range from about 0.2 mm to 10 mm, more preferably from 1 mm to 5 mm. A second motor is provided for cyclically translating the second sieve. An elongate sifter is provided, with the first sieve being translatably held within the sifter. The second sieve is preferably held within a hopper which is positioned above the sifter. In this way, the fine powder may be placed within the hopper, sifted through the second sieve and into the sifter, and sifted through the first sieve and into the chambers.

In still a further aspect, a receptacle holder is provided for holding an array of receptacles. The chambers in the rotatable member are preferably aligned in rows, and a means is provided for moving one of the chamber rows in alignment with a row of receptacles. Some of the chambers may then be emptied into the row of receptacles. The moving means then moves the chamber row in alignment with a second row of receptacles without rotating or refilling the chambers in the row. The remainder of the filled chambers are then emptied into the second row of receptacles. In this manner, the array of receptacle may be rapidly filled without rotating or refilling the chambers. In another aspect, a motor is provided for rotating the member, and actuation of the motor is controlled by the controller. Preferably, the moving means is also controlled by the controller.

DESCRIPTION OF THE PREFERRED EMBODIMENT

Figure 1:
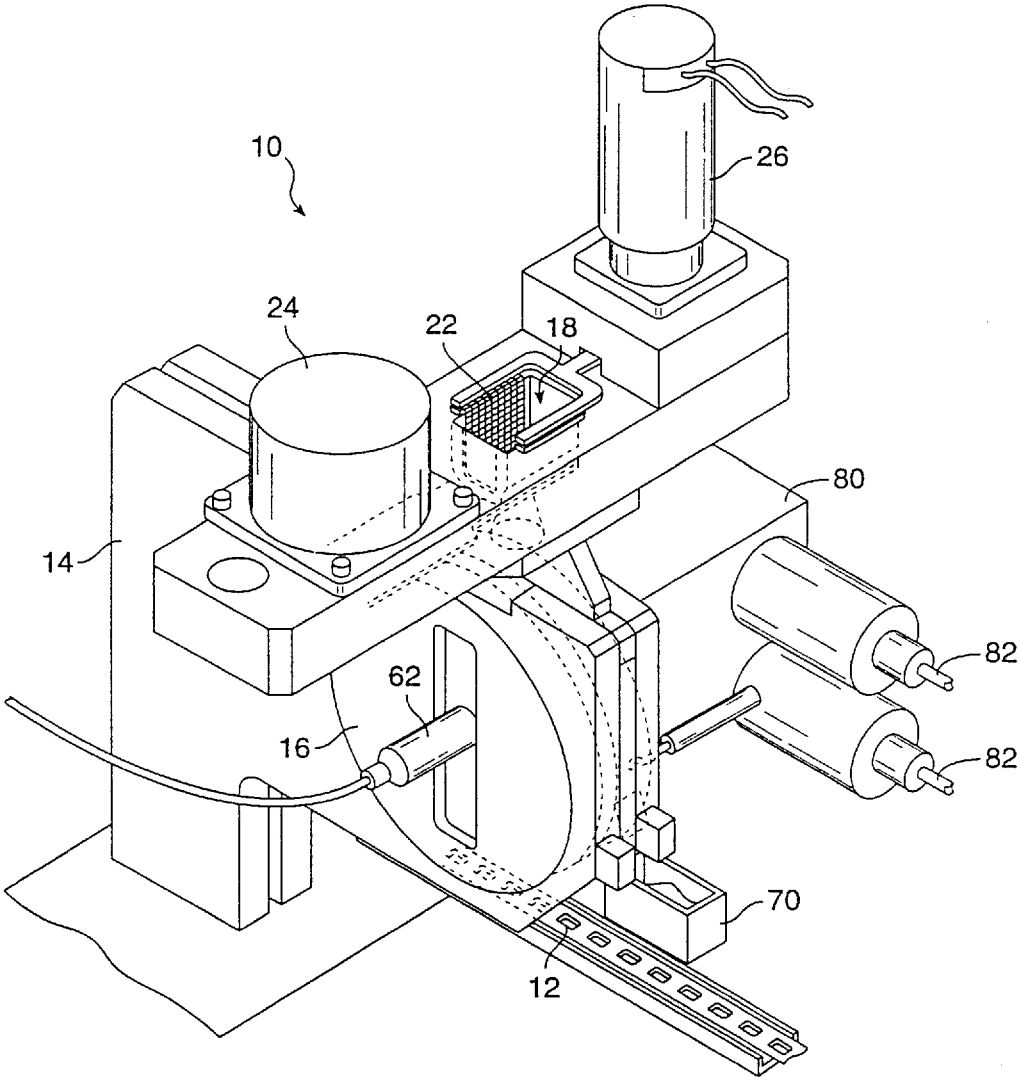
FIG. 1 is a perspective view of an exemplary apparatus for filling a receptacles with unit dosages of a fine powder medicament according to the present invention.

The invention provides methods, systems, and apparatus for the metered transport of fine powders into receptacles. The fine powders are very fine, usually having a mean size in the range that is less than about 20 $\mu$m, usually less than about 10 $\mu$m, and more usually from about 1 $\mu$m to 5 $\mu$m, although the invention may in some cases be useful with larger particles, e.g., up to about 50 $\mu$m or more. The fine powder may be composed of a variety of constituents and will preferably comprise a medicament such as proteins, nucleic acids, carbohydrates, buffer salts, peptides, other small biomolecules, and the like. The receptacles intended to receive the fine powder preferably comprise unit dose receptacles. The receptacles are employed to store the unit dosage of the medicament until needed for pulmonary delivery. To extract the medicament from the receptacles, an inhalation device is employed as described in copending U.S. application Ser. No. 08/309,691, previously incorporated herein by reference. However, the,methods of the invention are also useful in preparing powders to be used with other inhalation devices which rely on the dispersement of the fine powder.

The receptacles will preferably each be filled with a precise amount of the fine powder to ensure that a patient will be given the correct dosage. When metering and transporting the fine powders, the fine powders will be delicately handled and not compressed, so that the unit dosage amount delivered to the receptacle is sufficiently dispersible to be useful when used with existing inhalation devices. The fine powders prepared by the invention will be especially useful with, although not limited to, "low energy" inhalation devices which rely on manual operation or solely upon inhalation to disperse the powder. With such inhalation devices, the powder will preferably be at least 20% dispersible, more preferably be at least 60% dispersible, and most preferably at least 90% dispersible. Since the cost of producing the fine powder medicaments are usually quite expensive, the medicament will preferably be metered and transported into the receptacles with minimal wastage. Preferably, the receptacles will be rapidly filled with the unit dosage amounts so that large numbers of receptacles containing the metered medicament can economically be produced.

To provide such features, the invention provides for the fluidizing of the fine powder prior to the metering of the fine powder. By "fluidizing" it is meant that the powder is broken down into small agglomerates and/or completely broken down into its constituents or individual particles. This is best accomplished by applying energy to the powder to overcome the cohesive forces between the particles. Once in the fluidized state, the particles or small agglomerates can be independently influenced by other forces, such as gravity, inertia, viscous drag, and the like. In such a state, the powder may be made to flow and completely fill a capturing container or chamber without the formation of substantial voids and without the necessity of compacting the powder until it becomes non-dispersible, i.e. the powder is prepared such that it is easy to control its density so that accurate metering may be achieved while still maintaining the dispersibility of the powder. A preferred method of fluidizing is by sifting (i.e. as with a sieve) where the powder is broken into small agglomerates and/or individual particles, with the agglomerates or particles being separated so that they are free to move independently of each other. In this manner, the small agglomerates or individual particles are aerated and separated so that the small agglomerates or particles can, under certain conditions, move freely (i.e. as a fluid) and will uniformly nestle among each other when placed within a container or receptacle to create a very uniformly and loosely packaged dose of powder without the formation of substantial voids. Other methods for fluidizing include blowing a gas into the fine particles, vibrating or agitating the fine particles, and the like.

Upon fluidization of the fine particles, the fine particles are captured in the metering chamber (which is preferably sized to define a unit dosage volume). A preferable method of capturing is by drawing air through the chamber so that the drag force of the air will act upon each small agglomerate or individual particle. In this way, each small agglomerate or particle is individually guided into a preferred location within the container so that the container will be uniformly filled. More specifically, as the agglomerates begin to accumulate within the chamber, some locations will have a greater accumulation than others. Air flow through the locations of greater accumulation will be reduced, resulting in more of the entering agglomerates being directed to areas of lesser accumulation where the air flow is greater. In this way, the fluidized fine powder fills the chamber without substantial compaction and without substantial formation of voids. Further, capturing in this manner allows the fine powder to be accurately and repeatably metered without unduly decreasing the dispersibility of the fine powder. The flow of air through the chamber may be varied in order to control the density of the captured powder.

After the fine powder is metered, the fine powder is ejected into the receptacle in a unit dosage amount, with the ejected fine powder being sufficiently dispersible so that it may be entrained or aerosolized in the turbulent air flow created by an inhalation or dispersion device.

Referring to FIG. 1, an exemplary embodiment of an apparatus 10 for metering and transporting unit dosages of a fine powder medicament into a plurality of receptacles 12 will be described. The apparatus 10 includes a frame 14 holding a rotatable wheel 16 and a sifter 18 for receiving the fine powder in its manufactured (i.e., virgin) state. Translatably held within the sifter 18 is a first sieve 20 (see FIG. 4) and a second sieve 22. The sieves 20, 22 are for fluidizing the virgin fine powder prior to metering as described in greater detail hereinafter. A first motor 24 is provided for cyclically translating the first sieve 20, and a second motor 26 is provided for cyclically translating the second sieve 22.

Figure 2:
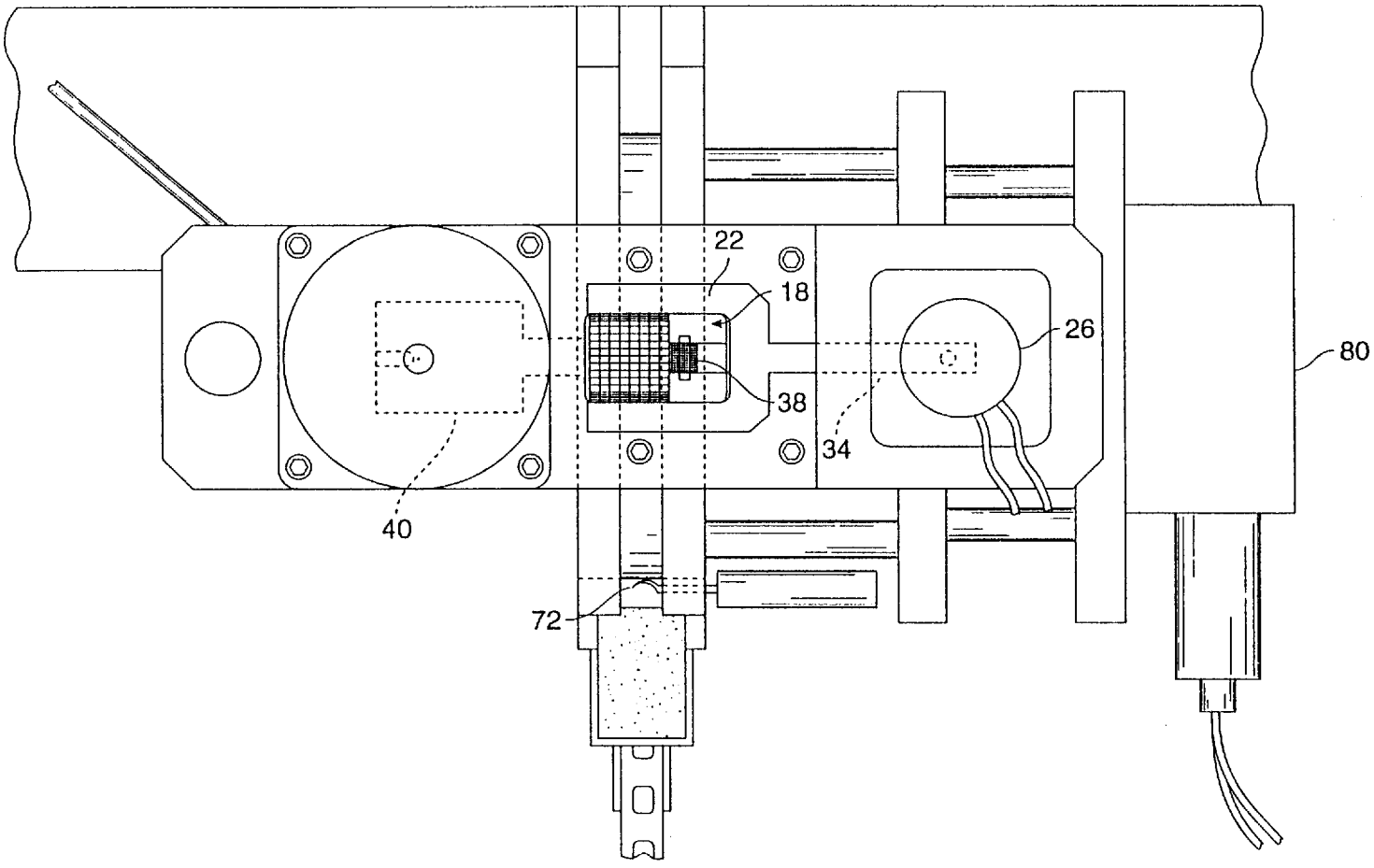
FIG. 2 is a top view of the apparatus of FIG. 1.
Figure 3:
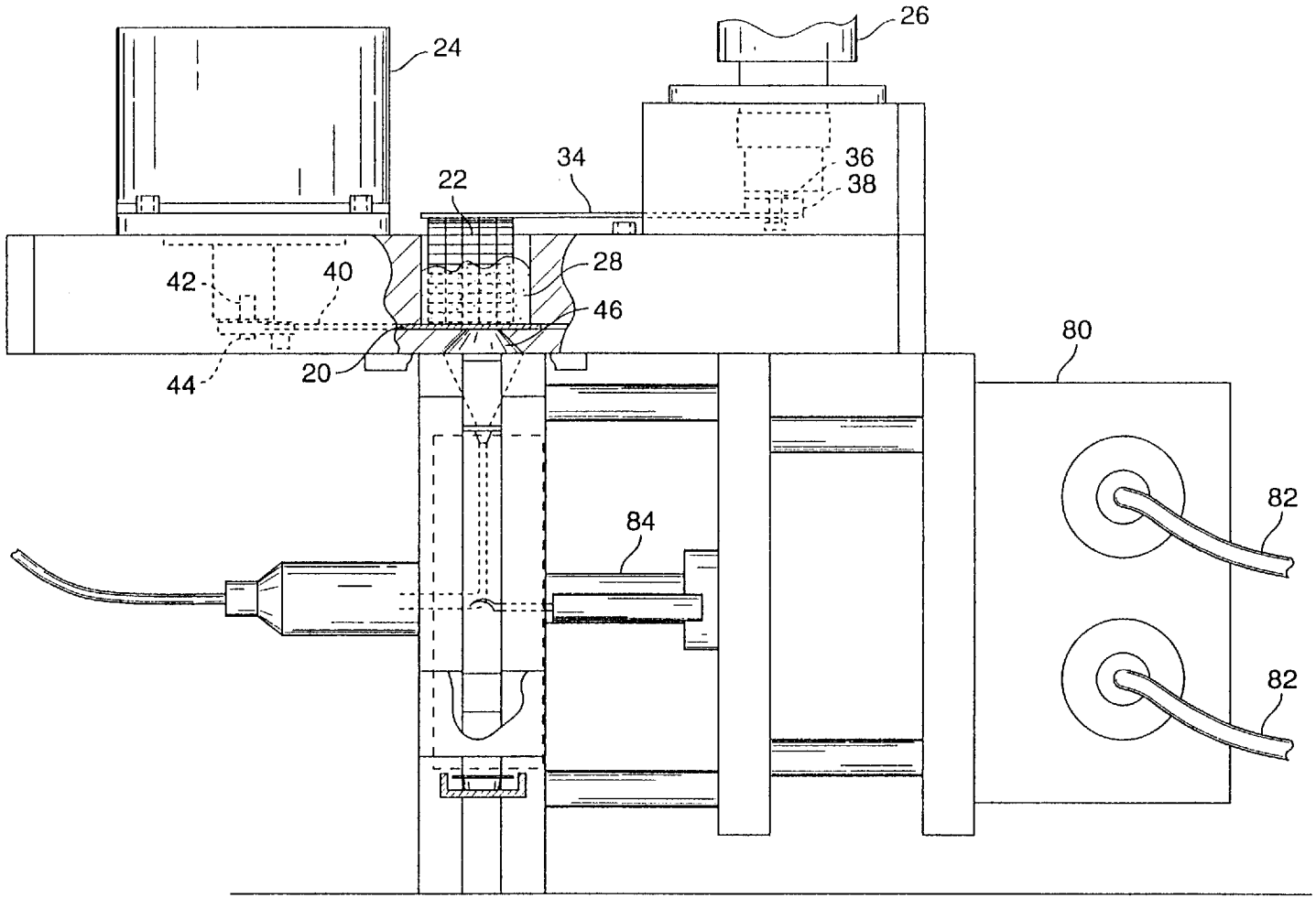
FIG. 3 is a front view of the apparatus of FIG. 1.
Figure 4:
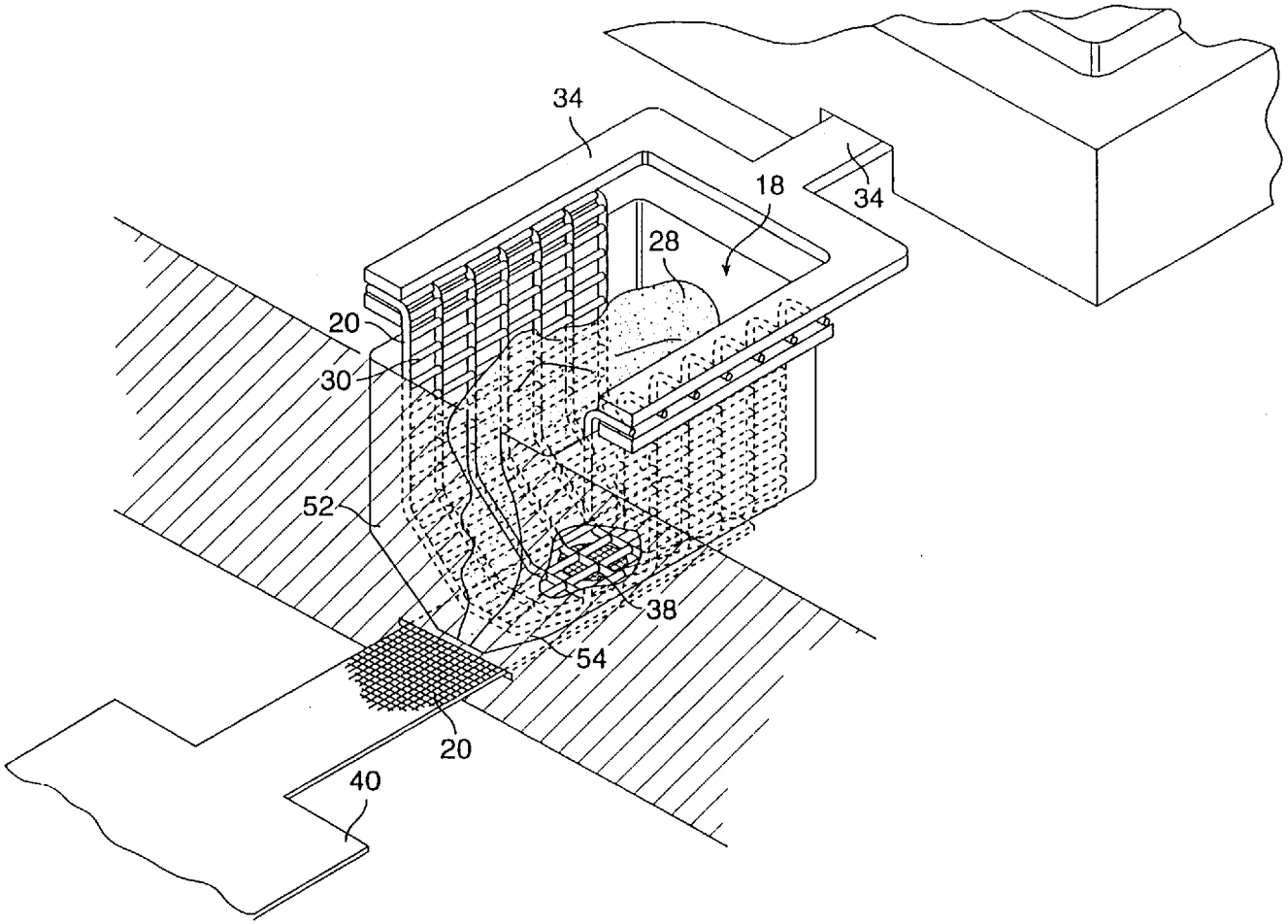
FIG. 4 is a perspective view of a sifter of the apparatus of FIG. 1 showing in greater detail a first and a second sieve that are held within the sifter.

Referring to FIGS. 2–4, operation of the sieves 20, 22 to fluidize an amount of virgin fine powder 28 will be described. As best shown in FIG. 4, the second sieve 20 comprises a screen 30 having a generally V-shaped geometry. The screen 30 is held in the sifter 18 by a frame 32 having an elongate proximal end 34 which interacts with the motor 26. Cyclical translation of the second sieve 22 is best shown in FIG. 3. The motor 26 includes a rotatable shaft 36 (shown in phantom) having a cam 38 (shown in phantom). The cam 38 is received into an aperture (not shown) in the proximal end 34 of the frame 32. Upon rotation of the shaft 36, the frame 32 is cyclically translated forwards and backwards in an oscillating pattern that may be a simple sinusoid or have some other translational motion. The motor 26 is preferably rotated at a speed sufficient to invoke cyclical translation of the second sieve 22 at a frequency in the range from about 1 Hz to 500 Hz, more preferably from 1 Hz to 500 Hz. The screen 30 is preferably constructed of a metal mesh and has apertures having a mean size in the range from about 0.1 mm to 10 mm, more preferably from 1 mm to 5 mm.

As the second sieve 22 is cyclically translated, the virgin fine powder 28 is sifted through the screen 30 and falls onto a screen 38 of the first sieve 20 (see FIG. 4). The screens 30 and 38 are preferably spaced apart by a distance in the range from 0.001 mm to 5 mm, with screen 30 being above screen 38. The screen 38 is preferably constructed of a metal mesh having apertures with a mean size from about 0.05 mm to 6 mm, and more preferably from about 0.1 mm to 3 mm. The first sieve 20 further includes a proximal portion 40 to couple the first sieve 20 to the motor 24. As best shown in FIG. 3, the second motor 24 includes a shaft 42 (shown in phantom) having a cam 44 (shown in phantom). The cam 44 is received into an aperture (not shown) in the proximal portion 40 and serves to cyclically translate the first sieve 20 in a manner similar to the cyclical translation of the second sieve 22. The screen 38 is preferably cyclically translated at a frequency in the range from about 1 Hz to about 500 Hz, and more preferably from about 10 Hz to 200 Hz. As the fine powder 28 is sifted from the screen 30 to the screen 38, cyclical translation of the first sieve 20 further sifts the fine powder 28 through the screen 38 where it falls through the sifter 18 and through an aperture 46 in a fluidized state.

As shown in FIG. 4, the sifter 18 includes two tapered sidewalls 52 and 54 that generally conform to the shape of the screen 30. The tapered side walls 52, 54 and the tapered geometry of the screen 30 assist in directing the powder 28 onto the screen 30 of the second sieve 22 where it is generally positioned over the aperture 46. Although the apparatus 10 is shown with first and second sieves 20 and 22, the apparatus 10 can also operate with only the first sieve 20 or alternatively with more than two sieves.

Although the screens 30 and 38 are preferably constructed of a perforated metal mesh, alternative materials can be used such as plastics, composites, and the like. The first and second motors 24, 26 may be AC or DC servo motors, ordinary motors, solenoids, piezo electrics, and the like.

Figure 5:
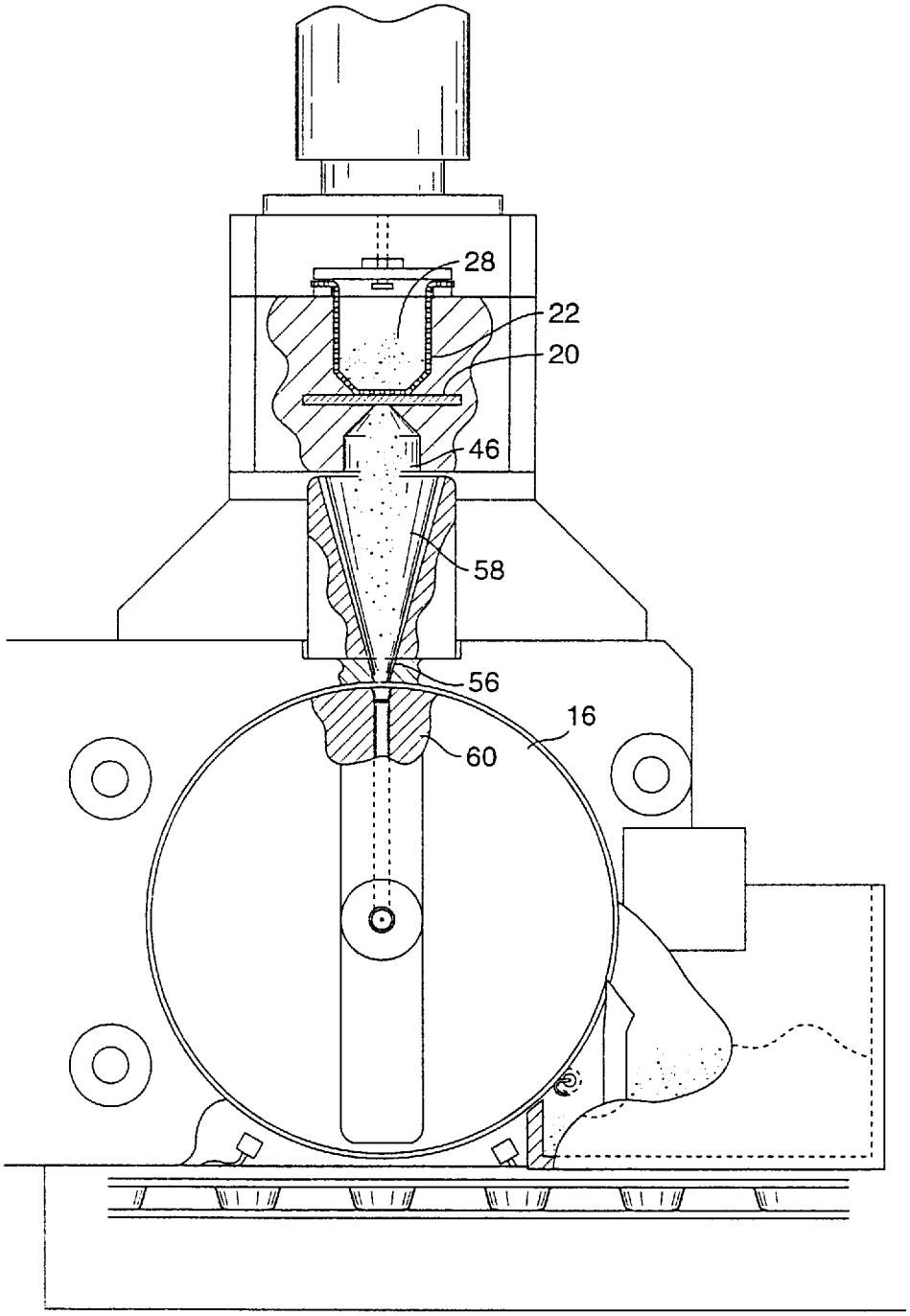
FIGS. 5–8 illustrate cutaway side views of the apparatus of FIG. 1 showing a metering chamber capturing the fluidized medicament, adjusting the captured medicament to be a unit dosage amount, adjusting the unit dosage amount to be a lesser unit dosage amount, and expelling the medicament into the unit dosage receptacle according to the present invention.

Referring now to FIGS. 1 and 5–8, the metered transport of the fine powder 28 to the receptacles 12 will be described in greater detail. Initially, the virgin fine powder 28 is placed in the sifter 18. The powder 28 may be placed into the sifter 18 by batch (such as by periodically pouring a predetermined amount) by continuous feed using an upstream hopper having a sieve at its bottom (such as shown in, for example, the embodiment of FIG. 17), by an auger, and the like. Upon placement of the powder into the sifter 18, the motors 24 and 26 are actuated to cyclically translate the first and second sieves 20, 22 as previously described. As best shown in FIG. 5, as the fine powder 28 is sifted through the second sieve 22 and the first sieve 20, the fine powder 28 becomes fluidized and falls through the aperture 46 and into a metering chamber 56 on the wheel 16. Optionally, a funnel 58 may be provided to assist in channeling the fluidized powder into the metering chamber 56. Connected to the metering chamber 56 is a vacuum/compressed gas line 60. The line 60 is connected at its opposite end to a hose 62 (see FIG. 1), which in turn is in communication with a vacuum source and a compressed gas source. A pneumatic sequencer (not shown) is provided for sequentially providing a vacuum, compressed gas or nothing through the line 60.

Upon fluidization of the fine powder 28, a vacuum is applied to the line 60 causing air flow into and through metering chamber 56 which assists in drawing the fluidized powder into the chamber 56. The metering chamber 56 preferably defines a unit dose volume so that when the chamber 56 is filled with captured fine powder 64, a unit dosage amount of the captured fine powder 64 is metered. Usually, the chamber 56 will be filled to overflowing with the captured powder 64 to ensure that the metering chamber 56 has been adequately filled.

Figure 6:
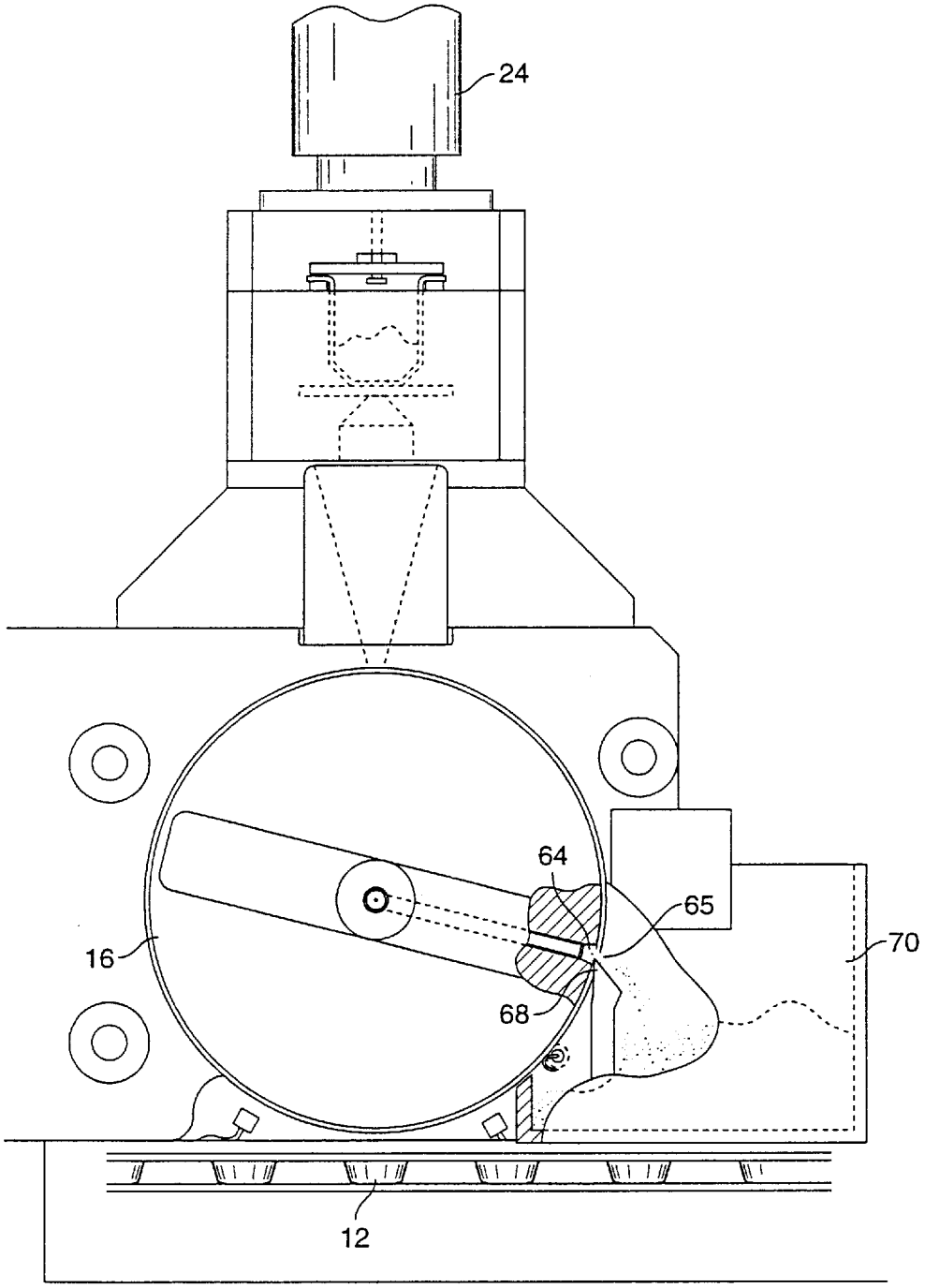

As best shown in FIG. 6, the invention provides for the removal of the excess powder 65, if necessary, so as to match the volume of captured powder 64 to the chamber volume, i.e. so that only a unit dosage amount of the fine powder 64 remains in the metering chamber 56. The removal of the excess powder 65 is accomplished by rotating the wheel 16 until the chamber 56 passes a trimming member 66 having an edge 68 which shaves off any excess captured powder 65 extending above the walls of the chamber 56. In this way, the remaining captured fine powder 64 is flush with the outer periphery of the wheel 16 and is a unit dosage amount. While the wheel 16 is rotated, the vacuum is preferably actuated to assist in maintaining the captured powder 64 within the chamber 56. A controller (not shown) is provided for controlling rotation of the wheel 16 as well as operation of the vacuum. The trimming member 66 is preferably constructed of a rigid material, such as delrin, stainless steel, or the like, and shaves off the excess powder into a recycle container 70. Over time, if powder is removed it accumulates in the recycle container 70 and may be recirculated by removing the container 70 and pouring the excess powder back into the sifter 18. In this way, wastage is prevented and production costs are reduced. When recirculating the powder, it may be desirable to provide additional sieves so that by passing virgin powder through multiple sieves, the effect of one extra sieving before passing it through the first sieve will be insignificant prior to capturing the fluidized powder in the chamber 56.

Figure 7:
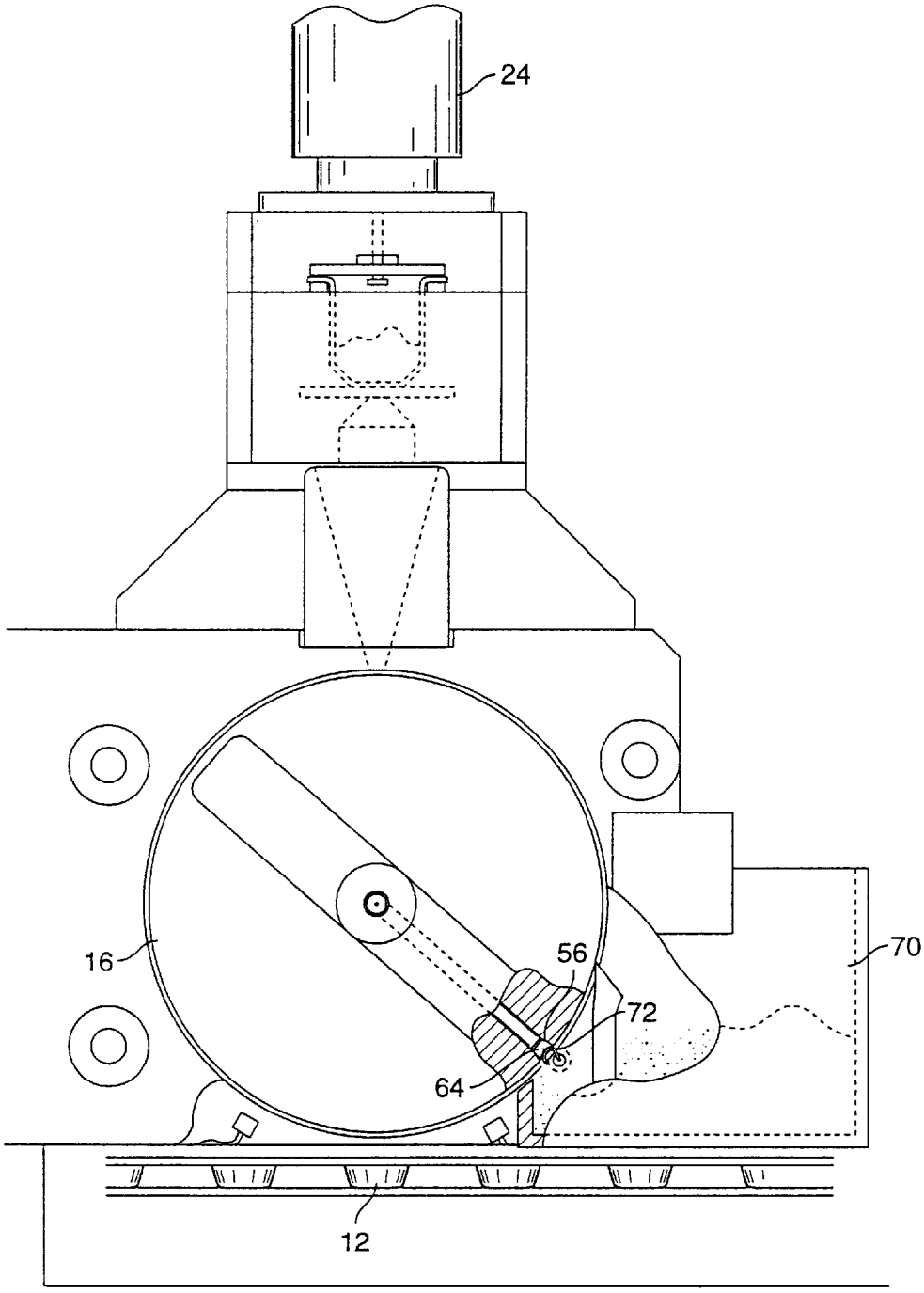

Referring to FIG. 7, it may sometimes be desirable to further adjust the unit dosage amount of the captured fine powder 64 to be a lesser amount of unit dosage. The apparatus 10 provides for such an adjustment without having to reconfigure the size of the chambers 56. The lesser amount of unit dosage is obtained by further rotation of the wheel 16 until the chamber 56 is aligned with a scoop 72. The position, size and geometry of the scoop 72 can be adjusted depending upon how much powder it is desired to remove from the chamber 56. When the chamber 56 is aligned with the scoop 72, the scoop 72 is rotated to remove an arced segment of the captured powder 64. The removed powder falls into the recycle container 70 where it can be recycled as previously described. Alternatively, a tooling change may take place to adjust the size of the chamber.

Figure 8:
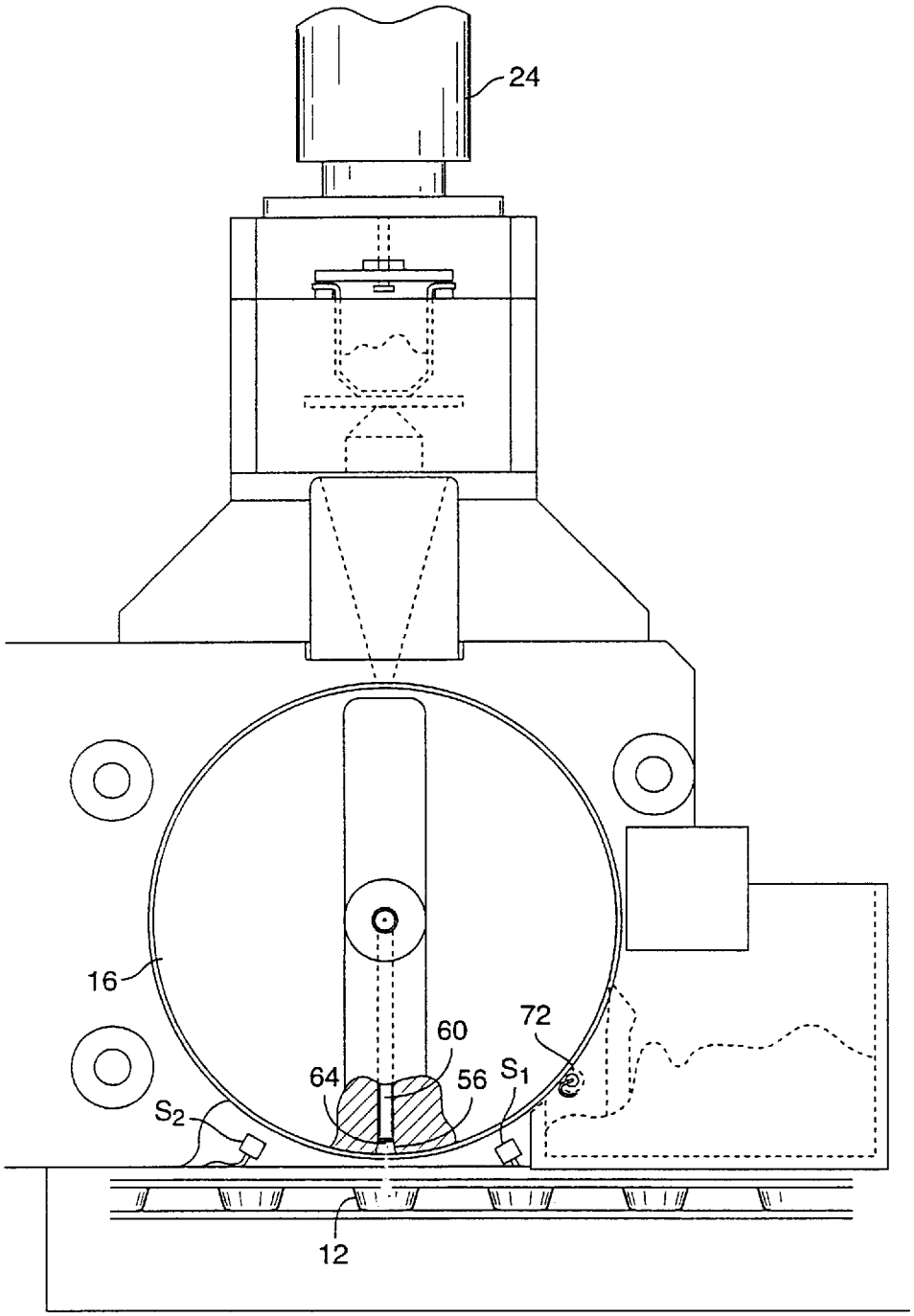

When the unit dosage amount of the captured powder 64 has been obtained, the wheel 16 is rotated until the chamber 56 is aligned with one of the receptacles 12 as shown in FIG. 8. At this point, operation of the vacuum is ceased and a compressed gas is directed through the line 60 to eject the captured fine powder 64 into the receptacle 12. The controller preferably also controls the movement of the receptacles 12 so that an empty receptacle is aligned with the chamber 56 when the captured powder 64 is ready to be expelled. Sensors S1 and S2 are provided to detect whether a unit dosage amount of the captured fine powder 64 has been expelled into the receptacle 12. The sensor S1 detects whether a unit dosage amount of the captured fine powder 64 exists within the chamber 56 prior to alignment of the chamber 56 with the receptacle 12. After expulsion of the powder 64, the wheel 16 is rotated until the chamber 56 passes the sensor S2. The sensor S2 detects whether substantially all of the powder 64 has been expelled into the receptacle 12. If positive results are obtained from both sensors S1 and S2, a unit dosage amount of the powder has been expelled into the receptacle 12. If either of the sensors S1 or S2 produces a negative reading, a signal is sent to the controller where the deficient receptacle 12 can be tagged or the system can be shut down for evaluation or repair. Preferable sensors include capacitance sensors that are able to detect different signals based on the different dielectric constants for air and the powder. Other sensors include x-ray and the like which may be employed to view inside the receptacle.

Figure 9:
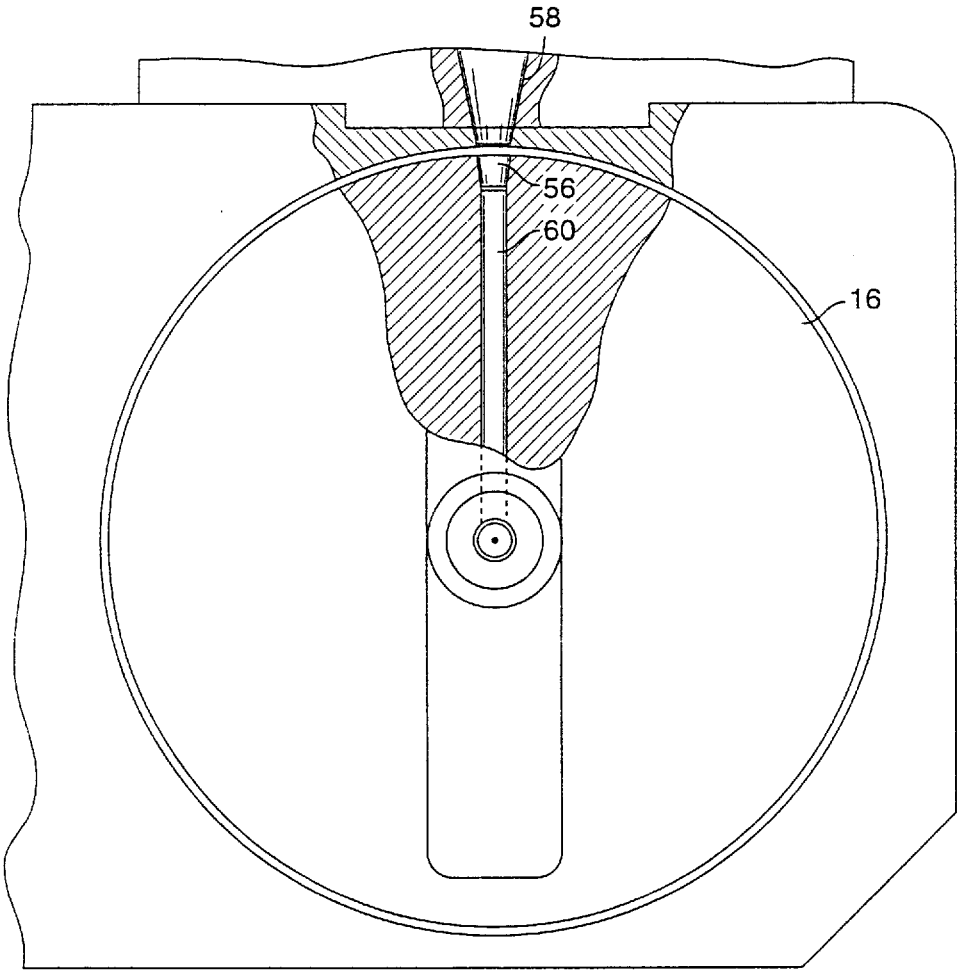
FIG. 9 is a more detailed side view of the metering chamber of the apparatus of FIG. 1 shown in a position for capturing fluidized fine powder.
Figure 10:
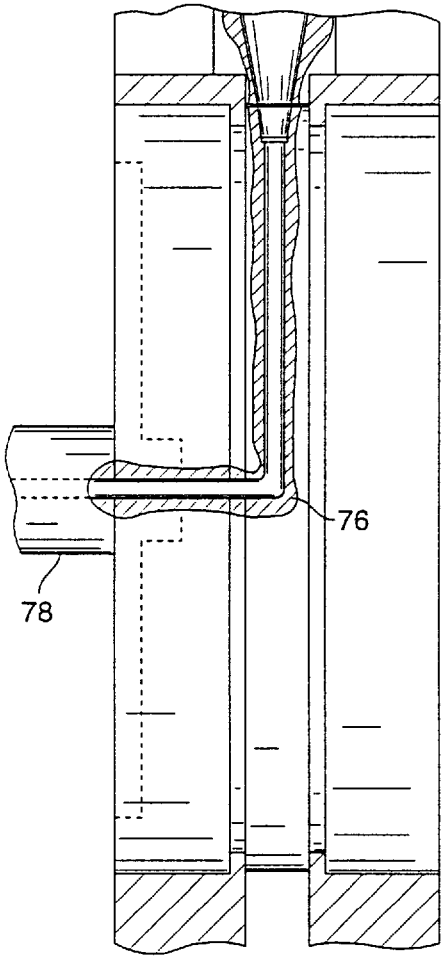
FIG. 10 is a cutaway side view of the metering chamber of FIG. 9 showing a vacuum/compressed gas line connected to the metering chamber.

Referring to FIGS. 9 and 10, construction of the rotatable wheel 16 will be described in greater detail. The wheel 16 can be constructed of a variety of materials such as metals, metal alloys, polymers, composites, and the like. The chamber 56 and the line 60 are preferably machined or molded into the wheel 16. A filter 74 is provided between the chamber 56 and the line 60 for holding the captured powder in the chamber while also allowing for gases to be transferred to and from the line 60. The line 60 includes an elbow 76 (see FIG. 10) to allow the line 60 to be connected with the hose 62. A fitting 78 is provided for connecting the hose 62 to the line 60.

Referring back to FIGS. 1 and 3, the wheel 16 is rotated by a motor 80, such as an AC servo motor. Alternatively, a pneumatic indexer may be used. Wires 82 are provided for supplying electrical current to the motor 80. Extending from the motor 80 is a shaft 84 (see FIG. 3) which is attached a gear reduction unit which turns the wheel 16. Actuation of the motor 18 rotates the shaft 84 which in turn rotates the wheel 16. The speed of rotation of the wheel 16 can be varied depending upon the cycle time requirements. The wheel 16 will be stopped during dispensing into the chamber 56, although in some cases the wheel 16 may be continuously rotated. Optionally, the wheel 16 can be provided with a plurality of metering chambers about its periphery so that a plurality of receptacles can be filled with unit dosages of the powder during one rotation of the wheel 16. The motor 80 is preferably in communication with the controller so that the wheel 16 is stopped when the chamber 56 comes into alignment with the funnel 58. If no funnel is included, the wheel 16 will stop when aligned with the sifter 18. The motor 80 is stopped for a period of time sufficient to fill the metering chamber 56. Upon filling of the chamber 56, the motor is again actuated until another chamber 56 comes into alignment with the funnel 58. While the chamber 56 is out of alignment with the funnel 58, the controller may be employed to stop operation of the motors 24 and 26 to stop the supply of fluidized powder.

When more than one chamber 56 is provided on the wheel 16, the scoop 72 will preferably be positioned relative to the wheel 16 such that when wheel 16 is stopped to fill the next metering chamber 56, the scoop 72 is aligned with a filled chamber 56. A plurality of lines 60 may be included in the wheel 16 so that each metering chamber 56 is in communication with the vacuum and compressed gas sources. The pneumatic sequencer can be configured to control whether a vacuum or a compressed gas exists in each of the lines 60 depending upon the relative location of its associated metering chamber 56.

Figure 11:
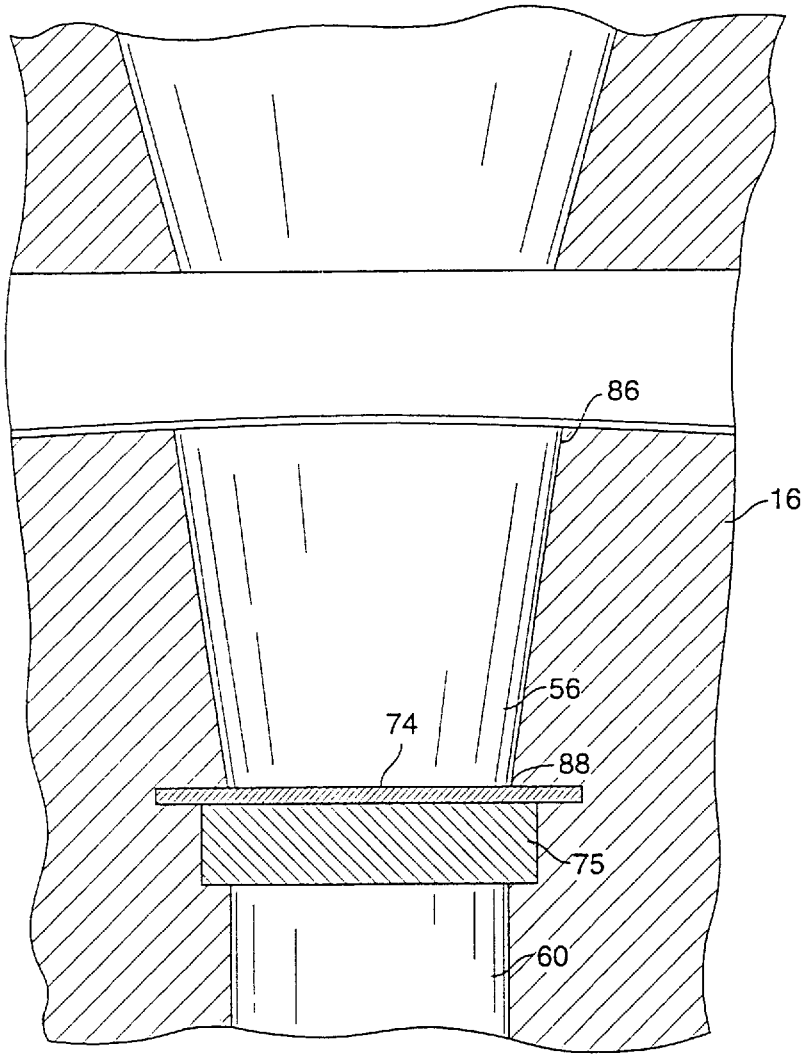
FIG. 11 is a closer view of the metering chamber of FIG. 9.

Referring to FIG. 11, construction of the metering chamber 56 will be described in greater detail. The metering chamber 56 preferably has a tapered cylindrical geometry, with the wider end of the chamber 56 being at the periphery of the wheel 16. As previously described, the chamber 56 preferably defines a unit dose volume and will preferably be in the range from about 1 $\mu$l to 50 $\mu$l, but can vary depending on the particular powder and application. The walls of the chamber 56 are preferably constructed of polished stainless steel. Optionally, the walls may be coated with a low friction material.

Held between the bottom end 88 and the line 60 is the filter 74. The filter 74 is preferably an absolute filter with the apertures in the filter being sized to prevent the powder from passing therethrough. When capturing powder having a mean size in the range from about 1 $\mu$m to 5 $\mu$m, the filter will preferably have apertures in the range from about 0.2 $\mu$m to 5 $\mu$m, and preferably at about 0.8 $\mu$m or less. A particularly preferable filter is a thin, flexible filter, such as a polycarbonate 0.8 $\mu$m filter. Use of a thin, flexible filter is advantageous in that the filter 74 may bellow outward when expelling the captured powder. As the filter bellows outward, the filter assists in pushing out the captured powder from the chamber 56 and also allows the apertures of the filter to stretch and allow powder trapped in the apertures to be blown out. Similarly, a filter material with pours that are tapered toward the same surface may be oriented such that removal of lodged particles is further enhanced. In this way, the filter cleans itself each time the captured powder is expelled from the cavity. A highly porous, stiff back-up filter 75 is positioned under the filter 74 to prevent billowing inward of the filter 74 which would change the chamber volume and allow powder to become trapped between the lower face of the chamber and the filter 74.

Figure 12:
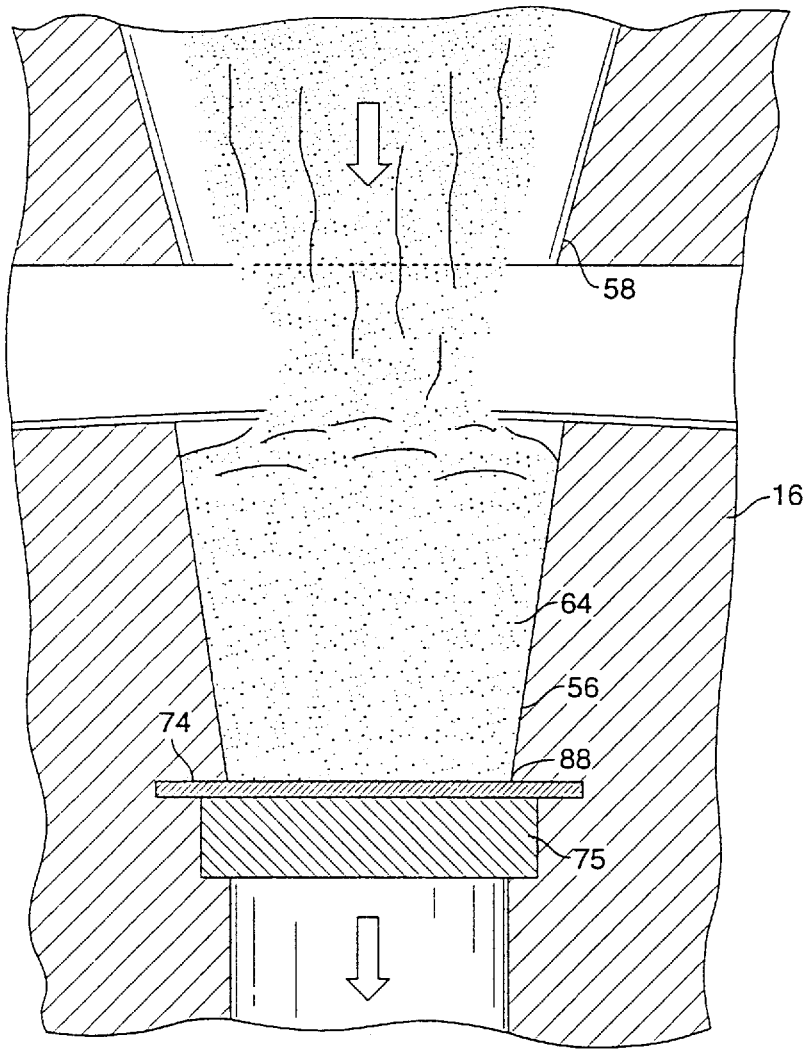
FIG. 12 shows the metering chamber of FIG. 11 being filled with fluidized fine powder according to the present invention.

Referring to FIG. 12, filling of the chamber 56 with the fluidized powder will be described in greater detail. The fluidized powder is drawn into the chamber 56 by the drag of the air flowing past the powder from the vacuum in the line 60. Sifting of the fine powder 28 is advantageous in that the powder is drawn to the bottom end 88 and uniformly begins piling up within the chamber 56 without the formation of voids and without clumping of the powder similar to how water would fill the chamber 56. If one side of the chamber 56 begins to accumulate more powder than the other side, the vacuum in the areas of lesser accumulation will be greater and will draw more of the entering powder to the side of the chamber 56 having a lesser accumulation. Elimination of voids during the filling process is advantageous in that the powder does not need to be compacted during the metering process which would increase the density and reduce the dispersibility of the powder, thereby reducing its ability to effectively be aerosolized or entrained in an air stream. Further, by eliminating voids, it can be assured that each time the chamber is filled, it will be filled with substantially the same dose of fine powder. Consistently obtaining uniform doses of powdered medicaments can be critical, since even minor variations may affect treatment. Because chamber 56 may have a relatively small volume, the presence of voids within the fine powder may greatly affect the resulting dose. Fluidization of the fine powder is provided to greatly reduce or eliminate such problems.

As previously described, the captured powder 64 is allowed to accumulate above the periphery of the wheel 16 to ensure that the chamber 56 is completely filled with the captured fine powder 64. The amount of vacuum employed to assist in drawing the fluidized powder into the chamber 56 will preferably be in the range from about 0.5 in Hg to 29 Hg, or greater at the bottom end 60. The amount of vacuum may be varied to vary the density of the captured powder.

Figure 13:
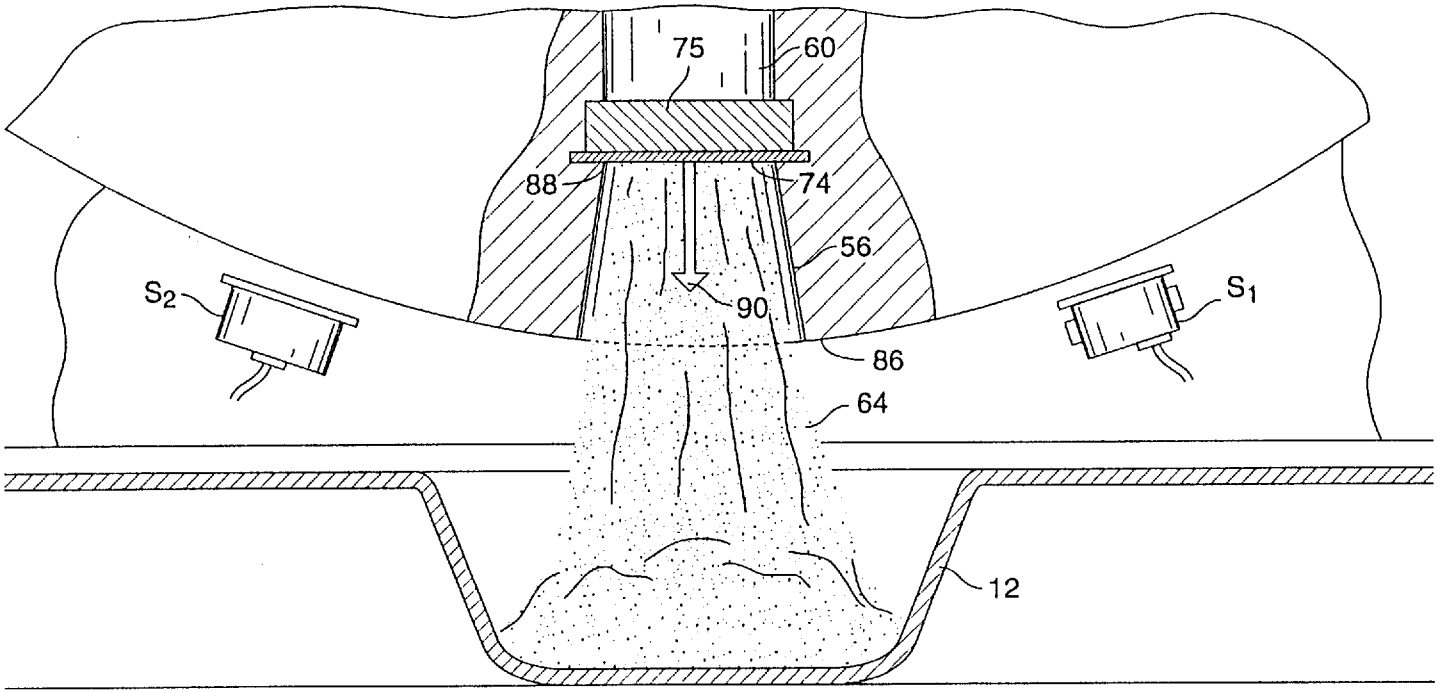
FIG. 13 is a closer view of the metering chamber of FIG. 8 showing the fine powder being ejected from the chamber and into the receptacle according to the present invention.

Referring to FIG. 13, expulsion of the captured fine powder 64 into the receptacles 12 will be described in greater detail. The receptacles 12 are joined together in a continuous strip (see FIG. 1) that is advanced so that a new receptacle 12 is aligned with the filled metering chamber 56 each time the chamber 56 is facing downward. Preferably, the controller will control translation of the receptacles 12 so that an empty receptacle 12 is aligned with the chamber 56 at the appropriate time. When the chamber 56 is facing downward, compressed gas is forced through the line 60 in the direction of arrow 90. The pressure of the gas will depend upon the nature of the fine powder. The compressed gas forces the captured powder 64 from the chamber 56 and into the receptacle 12. Tapering of the chamber 56 so that the top end 86 is larger than the bottom end 88 is advantageous in allowing the captured powder 64 to easily be expelled from the chamber 56. As previously described, the filter 74 is configured to bow outward when the compressed gas is employed to assist in pushing out the captured powder 64. Expulsion of the captured powder 64 in this manner allows the powder to be removed from the chamber 56 without excessive compaction. In this way, the powder received in the receptacle 12 is sufficiently uncompacted and dispersible so that it can be aerosolized when needed for pulmonary delivery as previously described. Optionally, the filled receptacle 12 can be subjected to vibratory or ultrasonic energy to reduce the amount of compaction of the powder.

Figure 14:
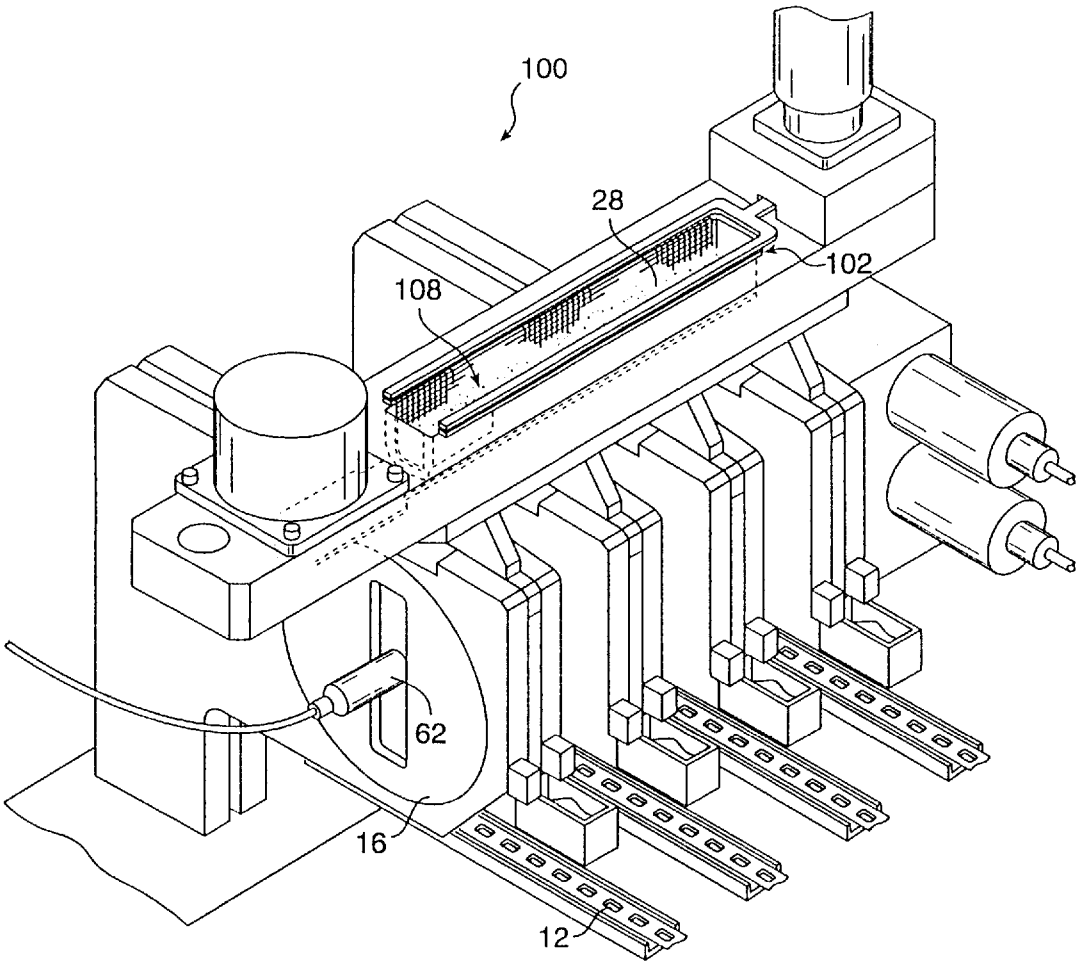
FIG. 14 is a perspective view of an exemplary system for filling a plurality of receptacles with unit dosages of a medicament of fine powder according to the present invention.

Referring to FIG. 14, an alternative embodiment of an apparatus 100 for filling receptacles 12 with unit dosages of fine powder will be described. The apparatus 100 is essentially identical to the apparatus 10 except that the apparatus 100 includes a plurality of rotatable wheels 16 and includes a larger fluidizing apparatus 102. For convenience of discussion, the apparatus 100 will be described using the same reference numerals as the apparatus 10 except for the fluidizing apparatus 102. Each of the wheels 16 is provided with at least one metering chamber (not shown) and receives and expels the powder in essentially the same manner as the apparatus 10. Associated with each wheel 16 is a row of receptacles into which the captured powder 64 is expelled. In this way, the controller can be configured to be essentially identical to the controller described in connection with the apparatus 10. The hose 62 provides a vacuum and compressed gas to each of the chambers 56 in the manner previously described.

Figure 15:
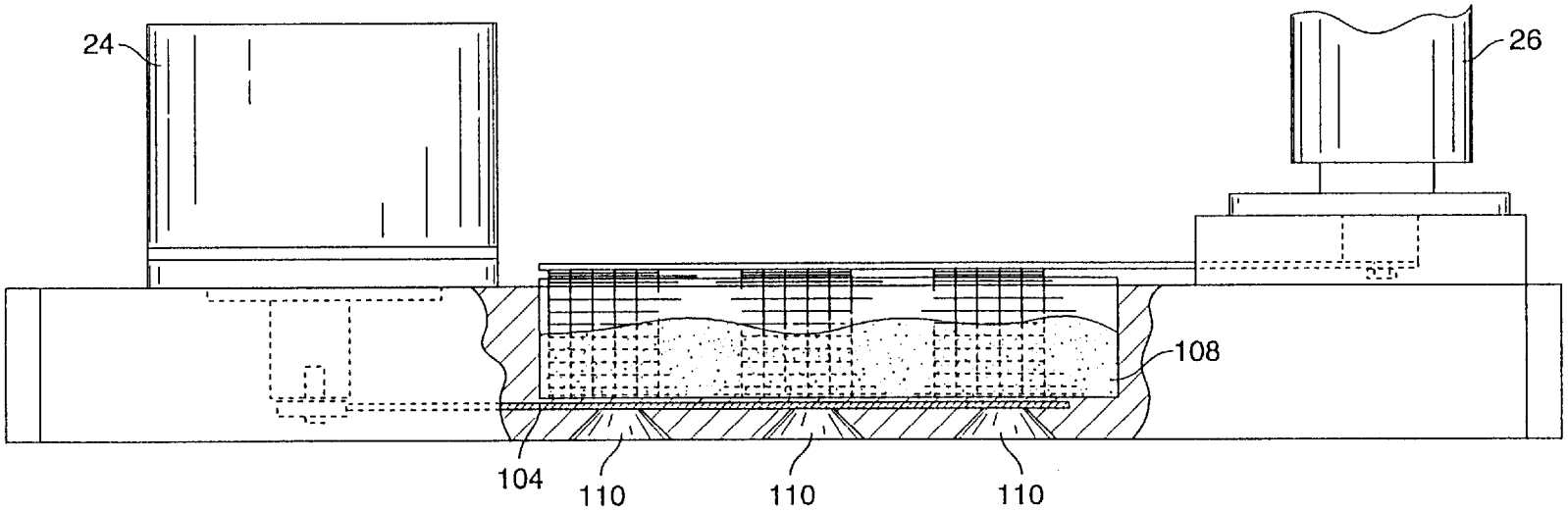
FIG. 15 is a cutaway side view of a sifter and a pair of sieves of the system of FIG. 14 used in fluidizing the medicament of fine powder according to the present invention.
Figure 16:
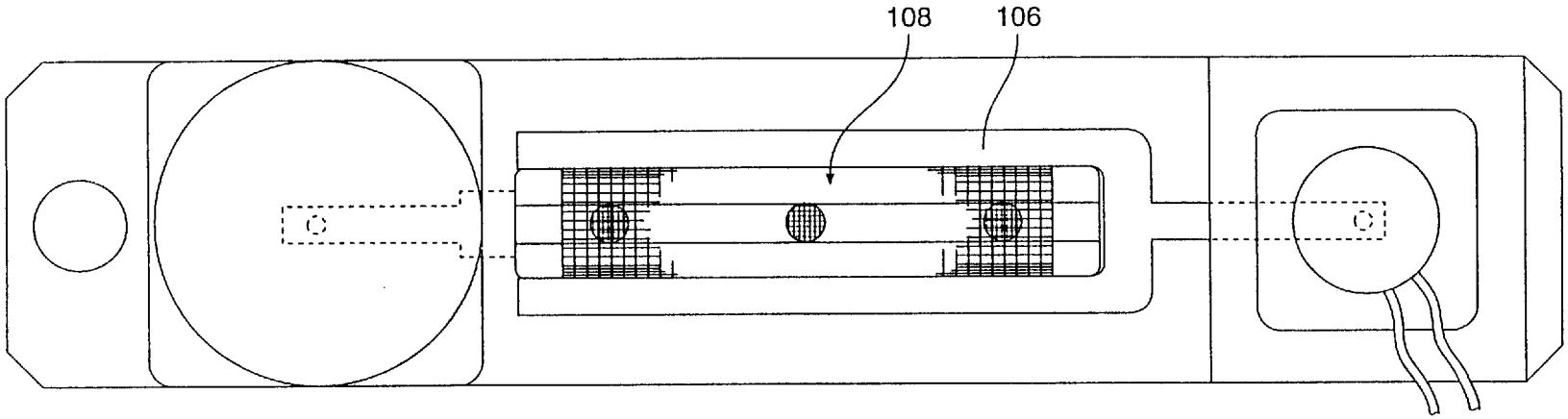
FIG. 16 is a top view of the sifter and sieves of FIG. 15.

Referring to FIGS. 15 and 16, operation of the fluidizing apparatus 102 will be described in greater detail. The fluidizing apparatus 102 includes a first sieve 104 and may optionally be provided with a second sieve 106. The first and second sieves 104, 106 are translatably held within an elongate sifter 108. The first and second sieves 104, 106 are essentially identical to the first and second sieves 20, 22, except that the first and second sieves 104, 106 are longer. In a similar manner, the sifter 108 is essentially identical to the sifter 18 except that the sifter 108 is longer in geometry and includes a plurality of apertures 110 (or a single elongate slot) for allowing the fluidized powder to simultaneously enter into the aligned chambers 56 of each of the wheels 16. Motors 24 and 26 are employed to cyclically translate the first and second sieves 104, 106 in essentially the same manner as previously described with the apparatus 10. The apparatus 100 is advantageous in that it allows for more receptacles 12 to be filled at the same time, thereby increasing the rate of the operation. The virgin fine powder 28 can be directly poured into the sifter 108 or can alternatively be augured, vibrated or the like into the sifter 108 to prevent premature compaction of the powder 28 prior to sifting. In another alternative, the fine powder 28 may be sifted into the sifter 108 from an overhead hopper as described in the embodiment of FIG. 17.

Figure 17:
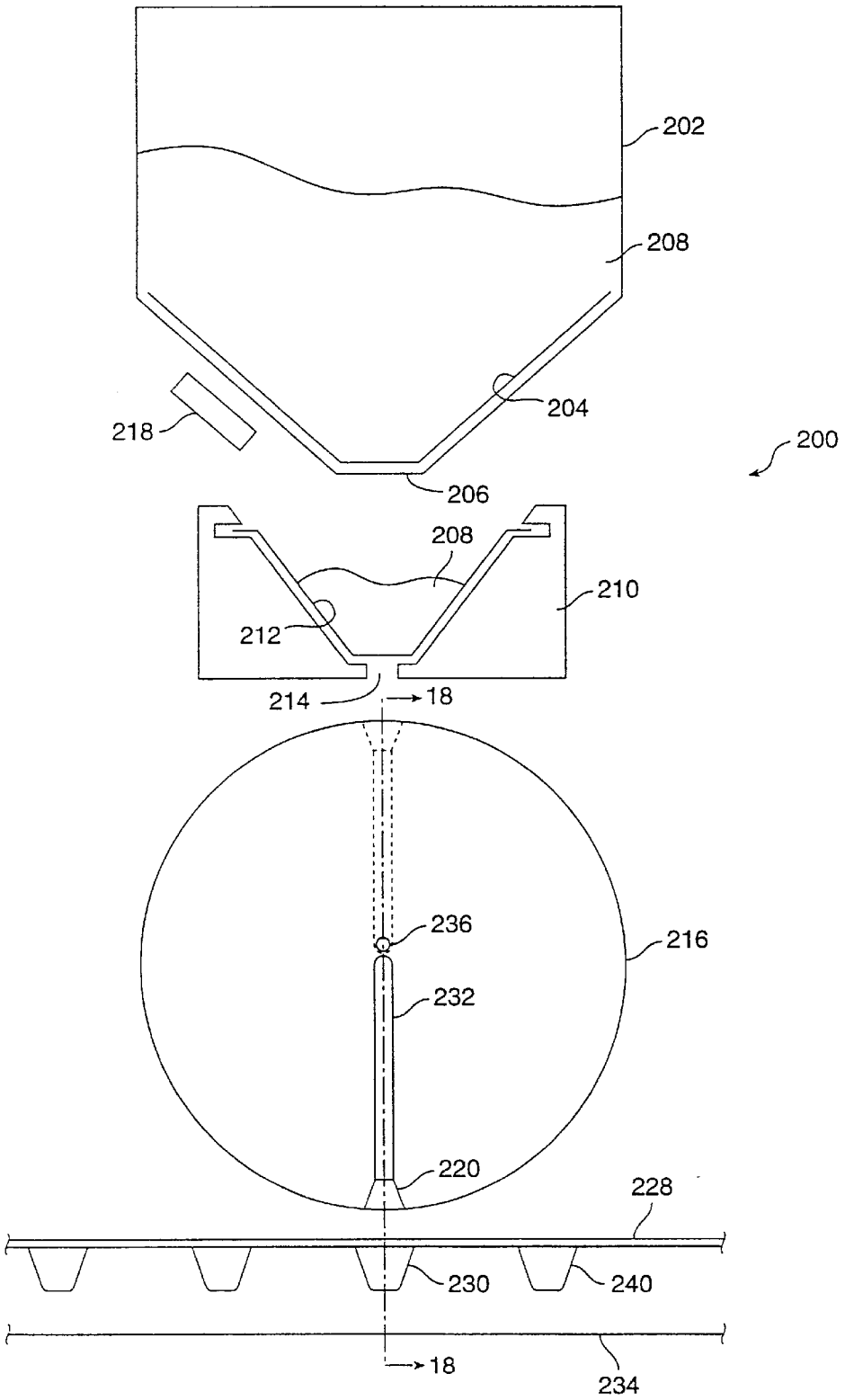
FIG. 17 is a schematic side view of another alternative embodiment of an apparatus for simultaneous filling multiple receptacles with unit dosages of fine powder.

FIG. 17 illustrates a particularly preferable embodiment of an apparatus 200 for rapidly and simultaneously filling a multiplicity of receptacles. The apparatus 200 includes a hopper 202 having a sieve 204. An opening 206 is provided at the bottom of the hopper 202 so that fine powder 208 held within the hopper 202 is sifted via the sieve 204 out the opening 206. With the assistance of gravity, the fine powder 208 falls into a sifter 210 which is positioned vertically below the hopper 202. The sifter 210 includes a sieve 212 which sifts the fine powder 208. An opening 214 is provided at the bottom of the sifter 210. Through opening 214, the sifted powder 208 falls (with the assistance of gravity) toward an elongate cylindrical rotatable member 216.

Sieve 212 preferably has apertures with a mean size in the range from about 0.05 mm to 6 mm, and more preferably from about 0.2 mm to 3 mm and is translated at a frequency in the range from about 1 Hz to about 500 Hz, and more preferably from about 10 Hz to 200 Hz. Sieve 204 preferably includes apertures with a mean size in the range from about 0.2 mm to 10 mm, more preferably from 1 mm to 5 mm. The second sieve is preferably translated at a frequency in the range from about 1 Hz to 500 Hz, more preferably from 1 Hz to 100 Hz.

A sensor 218, such as a laser sensor, is provided for detecting the amount of powder 208 within the sifter 210. Sensor 218 is in communication with a controller (not shown) and is employed to control actuation of the sieve 204. In this manner, sieve 204 may be actuated to sift powder 208 into the sifter 210 until a predetermined amount of accumulation has been reached. At this point, the sieve 204 is stopped until a sufficient amount has been sifted out of the sifter 210.

Figure 18:
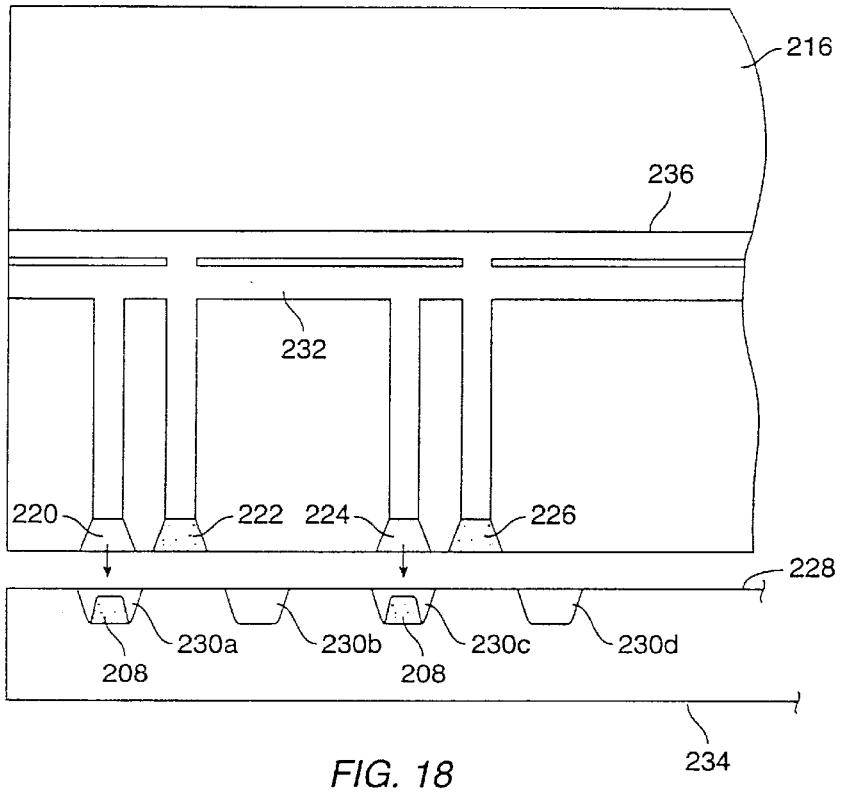
FIG. 18 is a side view of a cylindrical rotatable member taken along line 18—18 of FIG. 17 and shows a first set of receptacles being filled.

As best shown in FIG. 18, the rotatable member 216 includes a plurality of axially aligned chambers 220, 222, 224, 226 for receiving the powder 208 from the sifter 210. The rotatable member 216 may be provided with any number of chambers as needed and will each preferably be configured similar to the chamber 56 as previously described. Powder 208 is drawn into and ejected from the chambers similar to the apparatus 10 as previously described. In particular, air is drawn through each of the chambers 220, 222, 224, 226, to assist in simultaneously filling the receptacles with powder 208 when the chambers are aligned with the opening 214. Preferably, the amount of captured powder will be adjusted to match the chamber volume. Member 216 is rotated 180 degrees until facing an array of receptacles 228 which are formed into rows, e.g. rows 230 and 240. Compressed air is then forced through the chambers to eject the powder into the receptacles 228.

Figure 19:
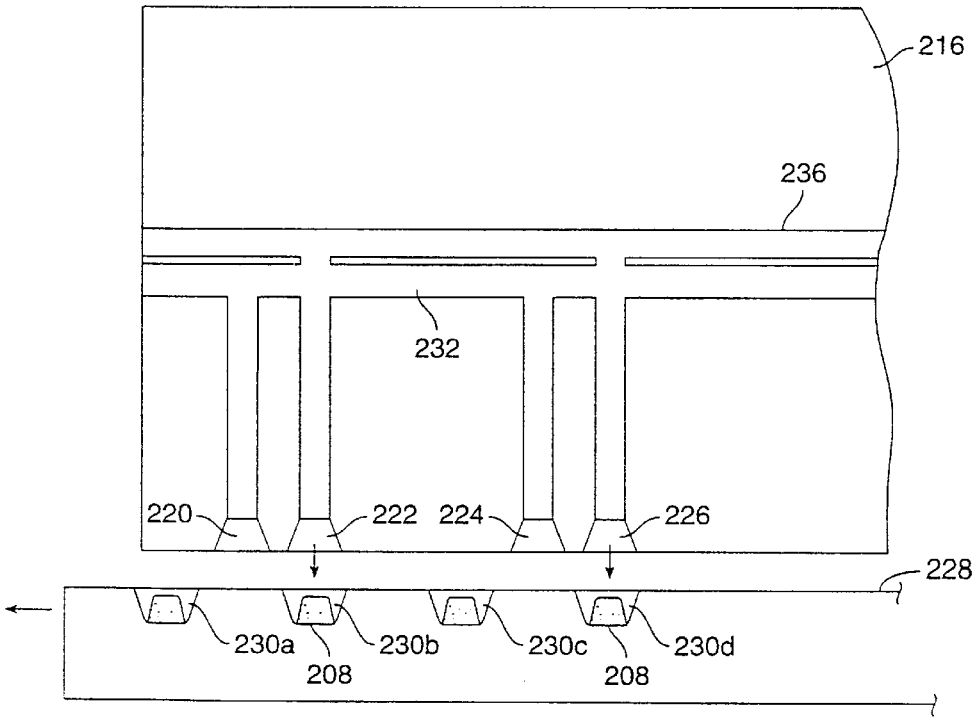
FIG. 19 is a side view of the rotatable member of FIG. 18 showing a second set of receptacles being filled.

Referring to FIGS. 18 and 19, a method for simultaneously filling the array of receptacles 228 using the apparatus 200 will be described. After the chambers 220, 222, 224, 226 are filled, they are aligned with row 230 (see FIG. 17) of receptacles 230*a*, 230*b*, 230*c*, 230*d*, with receptacles 230*a* and 230*c* being aligned with chambers 220 and 224 as shown in FIG. 18. Compressed air is then delivered through a line 232 to expel the powder from chambers 220, 224 into receptacles 230*a*, 230*c*, respectively. Rotatable member 216 is then translated to align chambers 222, 226 with receptacles 230*b*, 230*d*, respectively, as shown in FIG. 19. Compressed air is then delivered through a line 236 to expel the powder 208 into the receptacles 230*b*, 230*d* as shown. Alternatively, the array of receptacles 228 may be held in a receptacle holder 234 which in turn may be translatable to align the receptacles with the chambers.

After the receptacles of row 230 are filled, the receptacles of row 240 are then filled by rotating the member 216 180 degrees to refill the chambers 220, 222, 224, 226 as previously described. The array of receptacles 228 are advanced to place row 240 in the same position that row 230 previously occupied and the procedure is repeated.

Figure 20:
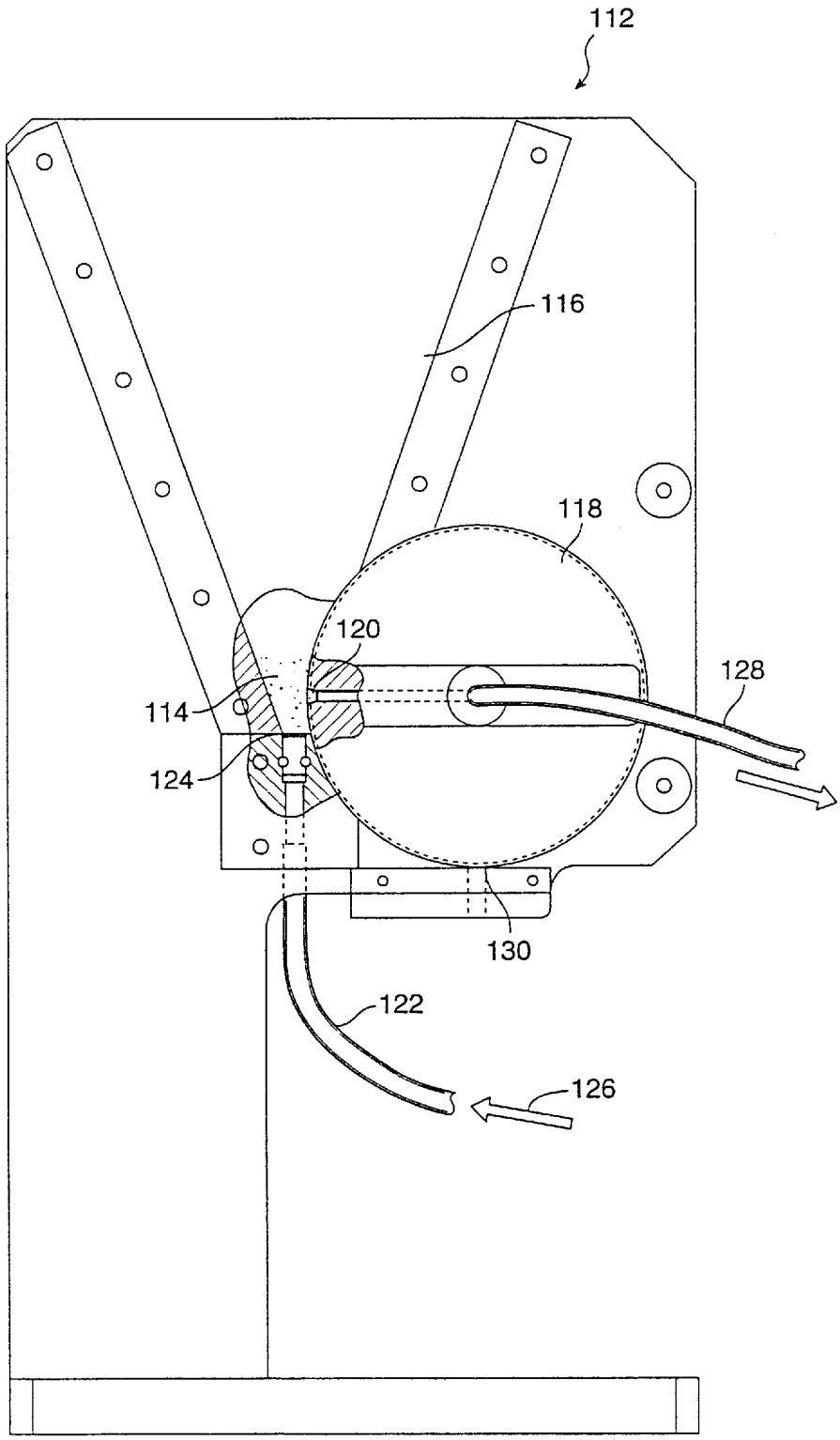
FIG. 20 is a cutaway side view of an alternative embodiment of an apparatus for metering and transporting fine powder into a receptacle according to the present invention.

Shown in FIG. 20 is an alternative embodiment of an apparatus 112 for filling receptacles with unit dosages of a fine powder 114. The apparatus 12 includes a receiving hopper 116 for receiving the fine powder 114. The hopper 116 is tapered inward so that the fine powder 140 accumulates at the bottom of the hopper 116. A wheel 118 having a metering chamber 120 extends into the hopper 116 so that the metering chamber 120 is in communication with the fine powder 114. The wheel 118 and metering chamber 120 can be constructed essentially identical to the wheel 16 and metering chamber 56 of the apparatus 10. To fluidize the fine powder 114, a line 122 is provided and extends to a bottom end 124 of the hopper 116. A compressed gas is passed through the line 122, as shown by the arrow 126. The compressed gas blows through and fluidizes the fine powder 114 that is accumulated at the bottom end 124. While the fine powder 114 is being fluidized, a vacuum is created in the chamber 120 by a line 128 in a manner similar to that previously described with the apparatus 10. The vacuum draws in some of the fluidized powder 114 into the chamber 120 to fill the chamber 12 with powder. After the chamber 120 is filled, the wheel 118 is rotated past a doctoring blade (not shown) to scrape off excess powder. Wheel 118 is then further rotated until facing downward at position 130. At position 130, a compressed gas can be directed through the line 128 to expel the captured powder in a manner similar to that previously described.

Figure 21:
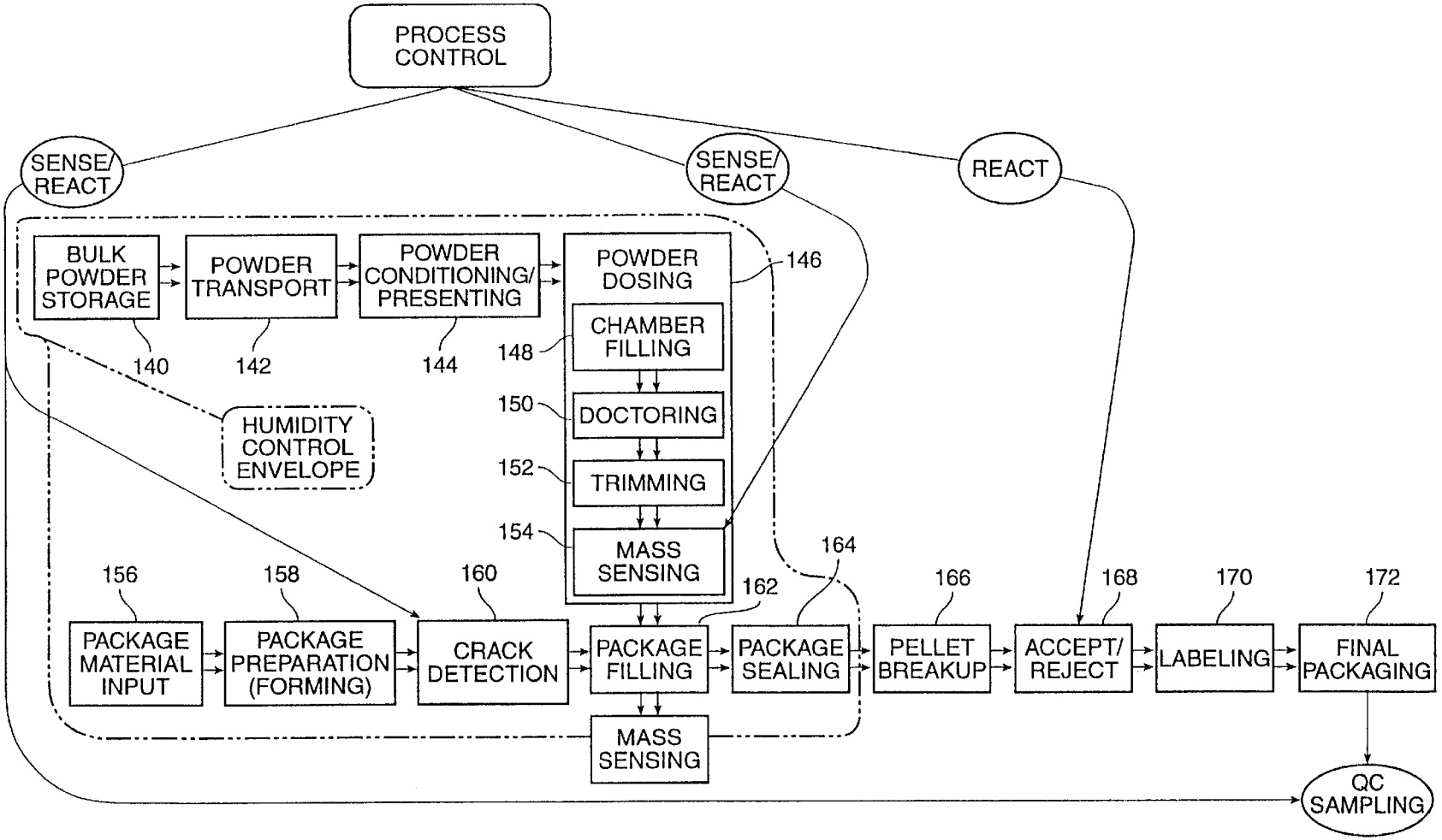
FIG. 21 is a flow chart illustrating an exemplary method for filling receptacles with unit dosages of a fine powder medicament according to the present invention.

Referring to FIG. 21, an exemplary method for filling blister packages with a fine powder medicament will be described. Initially, the powder is obtained from storage in bulk form as shown in step 140. The powder is then transported (step 142) into a powder-filling apparatus via an overhead hopper, such as the hopper of apparatus 200 as previously described. At step 144, the powder is conditioned by fluidizing the powder as previously described so that it can be properly metered. As shown in step 146, after the powder is properly conditioned, the fluidized powder is directed into a chamber until the chamber is filled (step 148). After the chamber is filled, the captured powder is doctored at step 150 to produce a unit dosage amount of the captured powder. Optionally, at step 152, the unit dosage amount can be trimmed to produce a lesser unit dosage amount. The remaining unit dosage amount of powder is then sensed (step 154) to determine whether the chamber has actually received an amount of the powder. At step 156, formation of the blister package begins by inputting the package material into a conventional blister packaging machine. The blister packages are then formed at step 158 and are sensed (step 160) to determine whether the packages have been acceptably produced. The blister package is then aligned with the metering chamber and the captured powder is expelled into the blister package at step 162. At step 163, a sensor is employed to verify that all powder has been successfully expelled into the receptacle. The filled package is then sealed at step 164. Preferably, steps 140 through 164 are all performed in a humidity-controlled environment so that the receptacles are filled with the medicament powder without being subjected to undesirable humidity variations. Optionally, after the blister package has been sealed, the package may be subjected to a pelletization breakup procedure at step 166 to loosen and uncompact the powder (if such has occurred) within the blister package. At step 168, the filled package is evaluated to determine whether it is acceptable or should be rejected. If acceptable, the package is labelled (step 170) and packaged (step 172).

Fluidization of fine powder as previously described may also be useful in preparing a bed of fine powder employed by conventional dosators, such as the Flexofill dosator, commercially available from MG. Such dosators include a circular trough (or powder bed) which is oriented in a horizontal plane and which may be rotated about its center. During rotation, the trough is filled by pouring a sufficient amount of flowable powder into the trough to create a specified depth within the trough. As the trough and the powder are rotated, the powder passes under a doctoring blade which scrapes off the excess powder and compresses it. In this way, the powder which passes under the doctoring blade is maintained at a constant depth and density. To meter (or dose) the powder, the bed is stopped and a thin wall tube is lowered into the powder some distance from the bed so that a cylindrical core of powder is captured in the tube. The volume of the dose is dependent on the inside diameter of the tube and the extent to which the tube is placed into the bed. The nozzle is then raised out of the bed and translated to a position directly over the receptacle into which the dose is to be dispensed. A piston within the nozzle is then driven downward to force the captured powder out of the end of the nozzle so that it can fall into the receptacle.

According to the present invention, the powder bed is filled with fine powder so that the powder has a uniform consistency, i.e. the fine powder is introduced onto the bed in a manner such that it does not clump together and form voids or local high density areas within the bed. Minimizing the voids and the high density areas is important since the dosing is defined volumetrically, usually being about 1 $\mu$l to about 100 $\mu$l, more typically being about 3 $\mu$l to about 30 $\mu$l. With such small doses, even small voids can greatly affect the volume of the captured dose while high density regions can increase the mass.

Uniform filling of the powder bed according to the invention is accomplished by fluidizing the fine powder before introducing the fine powder to the bed. Fluidization may be accomplished by passing the fine powder through one or more sieves similar to the embodiments previously described. As the powder leaves the sieves it uniformly piles in the bed without the formation of significant voids. Alternatively, fluidization of the fine powder after filling the bed may proceed by vibrating the bed to assist in "settling" the powder and reducing or eliminating any voids. In another alternative, a vacuum may be drawn through the bed to reduce or eliminate any voids.

After several doses have been taken from the bed, cylindrical holes remain within the bed. To continue dosing, the density of the bed must be re-homogenized. This may be done by re-fluidizing the powder so that it can flow together and fill the voids. To refresh the bed, a plow (such as an oscillating vertical screen) or beaters may be introduced into the bed to break up holes in any remaining powder. Optionally, all the powder could be removed and the entire bed re-prepared by re-sifting and combining with new powder. Also additional powder should be supplied as previously described to bring the powder level back to the original height. The trough is then rotated to doctor off any excess powder so that the remaining powder will be refreshed to its original consistency and depth. It is important that the additional powder be added via the sifter so that the condition of the incoming powder matches the existing powder in the bed. The sifter also allows uniform distribution of the incoming powder over a larger area thereby minimizing local high density regions caused by large clumps of incoming powder.

Although the foregoing invention has been described in some detail by way of illustration and example, for purposes of clarity of understanding, it will be obvious that certain changes and modifications may be practiced within tile scope of the appended claims.

What is claimed is:

1. A method for transporting powder having fine particles, comprising:

placing the powder into a hopper;

fluidizing at least some of the powder in the hopper by agitating the fine particles;

permitting said fluidized fine particles to fall mechanically unassisted from the hopper through a convergent flow path and into at least one metering chamber; and transferring the captured powder from said metering chamber to a receptacle, wherein the transferred powder is sufficiently uncompacted so that it may be dispersed upon removal from the receptacle.

2. A method as in claim 1, wherein the fine particles are fluidized by aerating and separating the fine particles and wherein the fine particles have a mean size in the range from about 1 $\mu$m to 100 $\mu$m.

3. A method as in claim 1, wherein the fluidizing step comprises sifting the fine powder.

4. A method as in claim 3, wherein the sifting step comprises cyclically translating a sieve to sift the fine powder through the sieve.

5. A method as in claim 4, wherein the sieve has apertures having a mean size in the range from 0.05 mm to 6 mm and wherein the sieve is translated at a frequency in the range from 1 Hz to 500 Hz.

6. A method as in claim 4, wherein the fluidizing step further comprises sifting the fine powder through a second sieve prior to sifting the fine powder through the first sieve.

7. A method as in claim 6, further comprising cyclically translating the second sieve to sift the fine powder through the second sieve.

8. A method as in claim 7, wherein the second sieve has apertures having a mean size in the range from 0.2 mm to 10 mm and wherein the second sieve is translated at a frequency in the range from 1 Hz to 500 Hz.

9. A method as in claim 7, wherein the first and the second sieves are translated in opposite directions relative to each other.

10. A method as in claim 1, wherein the fluidizing step comprises blowing a gas into the fine powder.

11. A method as in claim 1, further comprising drawing air through the chamber when positioned near the fluidized powder, wherein the drawn air assists in drawing the fine powder into the chamber.

12. A method as in claim 11, wherein the air is drawn through the chamber at a varying velocity to vary the force on the powder, whereby the density of the captured powder is varied to control the mass of the captured powder.

13. A method as in claim 11, wherein the divergent flow path comprises a funnel.

14. A method as in claim 13, further comprising introducing a compressed gas into the chamber to expel the captured powder.

15. A method as in claim 14, further comprising adjusting the unit dosage amount to be a lesser amount of unit dosage.

16. A method as in claim 11, wherein the transferring step comprises expelling the captured powder from the chamber and into the receptacle.

17. A method as in claim 16, further comprising detecting whether substantially all of the captured powder expelled from the chamber.

18. A method as in claim 17, further comprising producing an error message when substantially all of the captured powder is not expelled from the chamber.

19. A method as in claim 11, wherein the fine powder comprises a medicament, and further comprising removing an amount of the captured powder from the chamber so that a unit dosage of the fine powder remains in the chamber.

20. A method as in claim 19, further comprising removing an additional amount of the captured powder from the chamber to adjust the size of the unit dosage.

21. A method as in claim 19, further comprising recycling the amount of removed powder.

22. A method as in claim 1, further comprising adjusting the amount of captured powder to be a unit dosage amount.

23. A method as in claim 1, further comprising placing the captured powder into a plurality of receptacles.

24. A method as in claim 1, further comprising delivering mechanical energy to the receptacle after the transferring step.

25. A method for transferring a medicament of powder having fine particles with a mean size in the range from 1 $\mu$m to 100 $\mu$m, said method comprising: placing the powder into a hopper to form a powder bed;

sifting an amount of the powder from the powder bed to fluidize the fine powder;

allowing the fluidized powder to fall mechanically unassisted from the hopper and, through a convergent flow path until captured in a chamber that is positioned below the powder bed;

adjusting the amount of powder in the chamber to be a unit dosage amount; and transferring the unit dosage amount of powder from the chamber to a receptacle, wherein the transferred powder is sufficiently uncompacted so that it may be dispersed upon removal from the receptacle.

26. An apparatus for transporting powder having fine particles into at least one receptacle, said apparatus comprising: a hopper which is adapted to receive and hold the powder;

means for fluidizing the powder by agitation to aerate and separate the fine particles;

means positioned below the hopper and the fluidizing means for allowing at least a portion of the fluidized fine particles to fall mechanically unassisted through a convergent flow path and into a metering chamber; and means for ejecting the captured powder from the metering chamber and into the receptacle.

27. An apparatus as in claim 26, further comprising a means for drawing air through the chamber.

28. An apparatus as in claim 27, further comprising means for detecting whether substantially all of the captured powder is ejected from the chamber by the ejecting means.

29. An apparatus as in claim 27, further comprising a funnel which defines the convergent flow path.

30. An apparatus as in claim 27, wherein the chamber includes a bottom, a plurality of side walls, and an open top, and wherein at least some of the walls are angled inward from the top to the bottom.

31. An apparatus as in claim 30, wherein the chamber defines a unit dose volume.

32. An apparatus as in claim 30, further comprising a port in the bottom of the chamber, and wherein the means for drawing air comprises a vacuum source in communication with the port.

33. An apparatus as in claim 32, further comprising a filter disposed across the port.

34. An apparatus as in claim 33, wherein the filter has apertures having a mean size in the range from 0.1 $\mu$m to 100 $\mu$m.

35. An apparatus as in claim 33, wherein the vacuum source is variable to vary the flow velocity of air through the chamber.

36. An apparatus as in claim 35, wherein the flow velocity is varied by varying the vacuum pressure on a downstream side of the filter.

37. An apparatus as in claim, 32, wherein the means for ejecting the captured powder comprises a compressed gas source in communication with the port.

38. An apparatus as in claim 30, further comprising means for adjusting the amount of captured powder in the chamber to the chamber volume, whereby the captured amount is a unit dose amount.

39. An apparatus as in claim 38, wherein the adjusting means comprises an edge for removing fine powder extending above the walls of the chamber.

40. An apparatus as in claim 39, further comprising means for recycling the removed powder into the fluidizing means.

41. An apparatus as in claim 38, further comprising means for removing captured powder from the unit dosage amount in the chamber.

42. An apparatus as in claim 41, wherein the means for removing comprises a scoop.

43. An apparatus as in claim 38, wherein the means for adjusting the amount of captured powder comprises a second chamber which is interchangeable with the first chamber, the second chamber having a volume that is different from the volume of the first chamber.

44. An apparatus as in claim 26, wherein the means for fluidizing comprises a source of compressed gas for blowing the gas into the fine powder.

45. An apparatus as in claim 26, wherein the fine particles have a mean size in the range from about 1 $\mu$m to 100 $\mu$m.

46. An apparatus as in claim 45, wherein the means for fluidizing comprises a sieve having apertures with a mean size in the range from 0.05 mm to 6 mm.

47. An apparatus as in claim 46, further comprising a motor for cyclically translating the sieve, and wherein the motor translates the sieve at a frequency in the range from 1 Hz to 500 Hz.

48. An apparatus as in claim 46, wherein the means for fluidizing further comprises a second sieve having apertures with a mean size in the range from 0.2 mm to 10 mm.

49. An apparatus as in claim 48, further comprising a second motor for cyclically translating the second sieve.

50. An apparatus as in claim 49, wherein the second motor translates the second sieve at a frequency in the range from 1 Hz to 500 Hz.

51. An apparatus as in claim 48, further comprising a sifter, and wherein the first and the second sieves are translatably held within the sifter.

52. An apparatus as in claim 51, wherein the first and the second sieves are spaced-apart by a distance in the range from 0.001 mm to 5 mm and wherein the second sieve is above the first sieve.

53. An apparatus as in claim 52, wherein the sifter has a tapered geometry.

54. A system for filling receptacles with unit dosages of a medicament of fine powder, said system comprising:

a hopper having a top end and a bottom end;

an elongate rotatable member positioned below the hopper, the rotatable member having a plurality of chambers about its periphery;

at least one sifter positioned at the bottom end of the hopper for fluidizing at least some of the fine powder within the hopper;

an intermediate member defining a convergent flow path between the sifter and at least one of the chambers to allow the fluidized powder to fall mechanically unassisted from the sifter and into said chamber;

means for drawing air through the chambers to assist in capturing the fluidized powder in the chambers;

means for ejecting the captured powder from the chambers and into the receptacles;

a controller for controlling the means for drawing air and the ejecting means; and means for aligning the chambers with the fluidizing means and the receptacles.

55. A system as in claim 54, wherein the rotatable member is cylindrical in geometry.

56. A system as in claim 55, further comprising an edge adjacent the member for removing excess powder from the chambers as the member is rotated.

57. A system as in claim 55, further comprising a receptacle holder which holds the receptacles below the rotatable member.

58. A system as in claim 57, wherein the chambers are aligned in rows, and further comprising means for moving the rotatable member so that certain of the chambers are in alignment with a row of receptacles.

59. A system as in claim 58, wherein the moving means moves the rotatable member to move certain others of the chambers in alignment with a second row of receptacles, wherein the first and second rows of receptacles may be filled without rotating and refilling the chambers.

60. A system as in claim 58, further comprising a motor for rotating the member, and wherein actuation of the motor is controlled by the controller.

61. A system as in claim 55, wherein the sifter comprises a sieve having apertures with a mean size in the range from 0.05 mm to 6 mm.

62. A system as in claim 61, further comprising a motor for cyclically translating the first sieve.

63. A system as in claim 61, wherein the sifter further comprises a second sieve having apertures with a mean size in the range from 0.2 mm to 10 mm.

64. A system as in claim 63, further comprising a second motor for cyclically translating the second sieve.

65. A system for filling receptacles with unit dosages of a medicament of fine powder, said system comprising: a hopper which is adapted to receive and hold the powder an elongate rotatable member having a plurality of chambers about its periphery;

means for fluidizing the fine powder;

means for drawing air through the chambers to assist in capturing the fluidized powder in the chambers; an intermediate member defining a convergent flow path between the hopper and rotatable member to allow the fluidized fine powder to fall mechanically unassisted from the hopper and into the chamber;

means for ejecting the captured powder from the chambers and into the receptacles;

a controller for controlling the means for drawing air and the ejecting means;

means for aligning the chambers with the fluidizing means and the receptacles; and a receptacle holder which holds the receptacles below the rotatable member;

wherein the chambers are aligned in rows, and further comprising means for moving the rotatable member so that certain of the chambers are in alignment with a row of receptacles.

66. A system as in claim 65, wherein the moving means moves the rotatable member to move certain others of the chambers in alignment with a second row of receptacles, wherein the first and second rows of receptacles may be filled without rotating and refilling the chambers.

67. A system as in claim 65, further comprising a motor for rotating the member, and wherein actuation of the motor is controlled by the controller.

68. An apparatus for transporting fine powder into at least one receptacle, said apparatus comprising:

a hopper having a top end and a bottom end;

a sifter disposed near the bottom end of the hopper which fluidizes the fine powder as it exits the bottom end of the hopper by agitating the fine powder;

a chamber disposed below the sifter to capture at least a portion of the fluidized fine powder from the fluidized state;

an intermediate member defining a convergent flow path between the sifter and the chamber to allow the fluidized fine powder to fall mechanically unassisted from the sifter and into the chamber; and an ejection mechanism which ejects the captured powder from the chamber and into the receptacle.

* * * * *